US006847329B2

(12) United States Patent
Ikegaya et al.

(10) Patent No.: US 6,847,329 B2
(45) Date of Patent: Jan. 25, 2005

(54) PLATE-LIKE MULTIPLE ANTENNA AND ELECTRICAL EQUIPMENT PROVIDED THEREWITH

(75) Inventors: Morihiko Ikegaya, Tokyo (JP); Takahiro Sugiyama, Tokyo (JP); Shinichiro Suzuki, Tokyo (JP); Hisashi Tate, Tokyo (JP)

(73) Assignee: Hitachi Cable, Ltd. (JP)

( * ) Notice: Subject to any disclaimer, the term of this patent is extended or adjusted under 35 U.S.C. 154(b) by 0 days.

(21) Appl. No.: 10/280,178

(22) Filed: Oct. 24, 2002

(65) Prior Publication Data

US 2004/0008146 A1 Jan. 15, 2004

(30) Foreign Application Priority Data

Jul. 9, 2002 (JP) ..... 2002-199364

(51) Int. Cl.[7] ..... H01Q 1/24; H01Q 1/38; H01Q 9/06

(52) U.S. Cl. ..... 343/702; 343/830

(58) Field of Search ..... 343/700 MS, 702, 343/829, 830, 846, 741

(56) References Cited

U.S. PATENT DOCUMENTS 5,835,063 A 11/1998 Brachat et al.

6,552,686 B2 * 4/2003 Ollikainen et al. .. 343/700 MS

FOREIGN PATENT DOCUMENTS

| | | |
|---|---|---|
| EP | 0 749 176 A1 | 6/1995 |
| GB | 2 345 581 | 9/1998 |
| JP | 05-022018 | 1/1993 |
| WO | WO 00/52784 | 8/2000 |

* cited by examiner

*Primary Examiner*—Michael C. Wimer
(74) *Attorney, Agent, or Firm*—James B. Conte; Barnes & Thornburg LLP

(57) ABSTRACT

A slot 2 is defined by notching a conductor plate 1, a first radiation conductor 3 and a second radiation conductor 4 are disposed by sandwiching the slot 2 as a boundary, a third radiation conductor 5 connected to either of the first radiation conductor 3 or the second radiation conductor 4 is provided in the slot 2, if necessary, on and after third radiation conductors, for example, a fourth and fifth radiation conductors connected to either of the first radiation conductor 3 or the second radiation conductor 4 are provided, a power is supplied in the slot by the use of conductor edges of at least two radiation conductors, if required, whereby two monopole antennas and slot antennas, which use respective electric currents on the first radiation conductor 3 and the second radiation conductor 4, are electrically formed, besides, antennas other than that described above are electrically formed by utilizing electric currents over on and after the third radiation conductors.

12 Claims, 26 Drawing Sheets

36
CURVED
PLATE-LIKE
MULTIPLE
ANTENNA

37
CURVED
PLATE-LIKE
MULTIPLE
ANTENNA

38
CURVED
PLATE-LIKE
MULTIPLE
ANTENNA

PLATE-LIKE MULTIPLE ANTENNA AND ELECTRICAL EQUIPMENT PROVIDED THEREWITH

BACKGROUND OF THE INVENTION

1. Field of the Invention

The present invention relates to a plate-like multiple antenna composed of a conductor plate, which is compact and low-profile, besides, which may be easily housed in electric equipment such as personal digital assistance, and electrical appliances as well as in walls and the like; and the electrical equipment provided with such multiple antenna.

2. Prior Art

In recent years, downsizing for a variety of antennas for exclusive use in equipment including personal digital assistance, mobile computers, and the like (hereinafter referred simply to as "personal digital assistance" in a lump) except for large antennas for base station and satellite broadcasting has been actively made. Particularly, an antenna for personal digital assistance required for downsizing involves a problem of a space for installing the antenna, and a problem of a demand for performance acting counter to restriction in an antenna volume with downsizing of the personal digital assistance itself.

Furthermore, the same problem arises in a dimension of antenna itself with introduction of an antenna inside a wall in a room or introduction of such antenna into personal computer, electric appliances (hereinafter referred simply to "electric appliance" in a lump) or the like in a wireless network concept in home, which has been actively studied recently.

The above-described problem is due to such a cause that an exclusive space must be separately maintained in the case where an exclusive antenna is to be housed in a cabinet or a main body casing (hereinafter referred simply to as "cabinet" in a lump) in personal digital assistance or electric appliances. Moreover, with downsizing and weight reduction of products, an antenna itself is naturally required for downsizing and weight reduction thereof, so that it is difficult to satisfy required performance of the antenna.

Namely, it is necessary for maintaining a certain space for installing an antenna inside a cabinet for housing the antenna into the cabinet and maintaining its performance. As a result, there arises increase in manufactures' costs of the resulting products, and prolongation of a term for development, because of alteration of respective specifications, which have been heretofore employed.

In order to avoid these problems, substantially all of personal digital assistances or electric appliances use a separate cabinet outside the main body cabinet and to which an external antenna is attached by a separate cable.

In this manner, however, there are many cases wherein an external antenna must be once removed in the case when the personal digital assistances or electric appliances are transferred. In addition, troubles for reinstallation or readjustment of the antenna occur, there arises antenna damage due to routing of cables or the like, or unexpected troubles according to circumstances. Besides, a degree of freedom relating to a position for installing personal digital assistances or electric appliances is restricted. Thus, a user has been always accompanied with such troubles as described above.

For eliminating the problems as described above, there are typical well-known examples of a low-profile antenna, which can be housed in a clearance or the like inside a personal digital assistance or a cabinet of electric appliances, disclosed in Japanese Patent Laid-Open Nos. H5-22018 and H8-256009.

These well-known antennas are low-profile types, respectively, and they are easily manufactured. However, a constitution of these well-known antennas requires a wide ground section for obtaining high radiation gain by means of these antennas, so that the resulting product has a tendency of having a larger structure.

For this reason, in order to assure high radiation gain and to make the structure smaller, an earthing section (ground) or an earthing conductor (ground) of a high-frequency circuit in an equipment cabinet is connected directly with a ground section of an antenna in accordance with a high-frequency manner by means of metallic screws, welding or the like, whereby a distribution of electric current on the antenna is allowed to exist on the conductor part also, and finally the ground inside the equipment cabinet must be utilized as a part of ground section of the antenna.

In other words, it is required in the well-known examples that an antenna's ground section is connected directly with ground in a cabinet by means of metallic screws, welding or the like at a position or in a part of space where the antenna is to be installed, and as a result, these well-known antennas are not suitable for a demand of downsizing and weight reduction, so that these well-known antennas exhibit poor multiusability.

On one hand, a consumptive demand for such type of personal digital appliances that a plurality of wireless communication systems using radio waves of different frequency bands can be utilized by a single personal digital appliance are increasingly developing lately. Such demands are derived from countermeasures for a novel communication system aiming at speedup in communication speed, a tendency of high capacity of information, and adequate and differential services, or countermeasures for diversification in personal digital appliances, and a transitional period from an existing system to a novel communication system.

In these circumstances, if individual antennas are provided, respectively, for a plurality of frequencies to be used in a single personal digital appliance, it makes to be worse the above-mentioned problems. Thus, it is required that radio waves in a plurality of frequency bands can be transmitted and received by a single antenna.

As is apparent from the above description, respective exclusive antennas to be housed in personal digital appliances or home electric appliances for a wireless network in home must not bring increase in manufactures' costs of the resulting products, prolongation of a term for development and the like, but they can be easily introduced, and they can reduce users' troubles.

Furthermore, it is required that an antenna itself is inexpensive.

Moreover, it is necessary for realizing a multiple antenna by which radio waves in a plurality of frequency bands can be transmitted and received by a single antenna as countermeasures for diversification in personal digital appliances, and a plurality of communication systems.

SUMMARY OF THE INVENTION

In view of the above-described problems involved in the prior art, the present invention has been made.

Accordingly, an object of the present invention is to provide a plate-like multiple antenna and electrical equipment provided therewith wherein the antenna can be easily housed in a small space of a personal digital appliance, an electrical appliance, a wall or the like, the antenna is inexpensive and has good multiusability, and further, high radiation efficiency can be realized by the single antenna without employing an earthing section in a personal digital appliance or a cabinet for an electric appliance as a part of antenna.

In order to solve the above-described problems, a plate-like multiple antenna according to the present invention comprises a slot being defined by notching a conductor plate, a first radiation conductor and a second radiation conductor being disposed by sandwiching the slot as a boundary, a third radiation conductor connected to either of the first radiation conductor or the second radiation conductor being provided in the slot, if necessary, on and after third radiation conductors, for example, a fourth and fifth radiation conductors connected to either of the first radiation conductor or the second radiation conductor being provided, and a power being supplied in the slot by the use of conductor edges of at least two radiation conductors, if required.

According to a plate-like multiple antenna of the present invention, when four radiation conductors were fabricated, a power is supplied in a slot by using conductor edges of at least two radiation conductors, if necessary, i.e., conductor edges of a first radiation conductor and a second radiation conductor defining the slot, conductor edges of the first radiation conductor and a third radiation conductor defined in the slot, conductor edges of the first radiation conductor and a fourth radiation conductor defined in the slot, conductor edges of the second radiation conductor and the fourth radiation conductor, or conductor edges of the third radiation conductor and the fourth radiation conductor among a plurality of radiation conductors fabricated.

According to a plate-like multiple antenna of the present invention, the above-described power-supplying manner into the slot may be in such that on and after third radiation conductors defined in the slot are used for a power feeding line to the conductor edges of the first radiation conductor and the second radiation conductors.

According to a plate-like multiple antenna of the present invention, the above-described conductor plate is separately disposed from an earthing section of a high-frequency circuitry in equipment with which the antenna is loaded.

According to a plate-like multiple antenna of the present invention, the above-described slot is preferably defined at a position where it deviates from the center of the conductor plate, and the conductor plate is preferably arranged so as to involve a first radiation conductor and a second radiation conductor having a broader area than that of the first radiation conductor bounded by a central axis of the slot in the longitudinal direction.

According to a plate-like multiple antenna of the present invention, a dimension of the above-described first radiation conductor corresponding to a longitudinal direction of the above-described slot is preferably set to be an odd number times larger than an about ¼ of a wavelength in one radio wave among a plurality of radio waves applied.

According to a plate-like multiple antenna of the present invention, a width of the above-described slot is preferably set to be ⅛ or less than that of a wavelength of the above-described one radio wave.

In the above-described plate-like multiple antenna of the present invention, a wavelength of the radio wave applied is that of electromagnetic wave used for communication in wireless equipment loaded with the antenna.

According to a plate-like multiple antenna of the present invention, conductor edges defining the above-described slot and being opposite to each other in a first radiation conductor and a second radiation conductor have not necessarily the same distances with each other and are not parallel to each other.

According to a plate-like multiple antenna of the present invention, another radio wave having a different wavelength from that of the above-described one radio wave is transmitted and received by means of either only the radiation conductors to be defined in the above-described slot, or these conductors as well as a first radiation conductor and a second radiation conductor.

According to a plate-like multiple antenna of the present invention, a longitudinal dimension of a routing line of electric current distribution of an antenna constituted by the use of radiation conductors in the above-described slot is made to be an integer number times larger than about ⅛ of a wavelength of the above-described other radio wave wherein the length and the constitution can be freely selected dependent upon the purposes thereof.

According to a plate-like multiple antenna of the present invention, a power may be supplied by such a manner that an extended conductor section, which is prepared by extending a part of conductor edges of at least two radiation conductors among a plurality of radiation conductors in a slot downwards to a base wherein the above-described conductor plate is formed on an insulative base, is connected with a wiring pattern formed on a substrate of a high-frequency circuit.

According to a plate-like multiple antenna of the present invention, substantially the whole above-described conductor plate is preferably covered by an insulating material such as an insulating material wherein the insulating material is removed from a power feeding section through which a power is to be supplied. In this case, it is required to make dimensions in respective parts of an antenna somewhat smaller than that of the case where no laminate material has been applied to the conductor plate with respect to respective wavelengths of a plurality of radio waves applied with taking influences of dielectric constant derived from the laminate material (dielectric material) being the insulating material into consideration.

By the use of the insulating material, such a constitution that the above-described plate-like multiple antenna is not connected with an external ground section according to high-frequency manner can easily be assured, whereby characteristic property of a single plate-like multiple antenna can be easily maintained, so that it becomes possible to elevate versatility.

According to a plate-like multiple antenna of the present invention, a coaxial line composed of an inner conductor and an outer conductor positioned on the outer periphery of the inner conductor wherein these conductors are prepared by twisting a solid wire or a plurality of wires, respectively, is used as a power feeding line for the antenna, and both the inner and outer conductors at one end of the coaxial line may be connected to conductor edges of at least two radiation conductors thereby making a power supply possible in a slot of the plate-like multiple antenna.

According to a plate-like multiple antenna of the present invention, a part of conductor edges of respective radiation conductors for connecting with an inner conductor and an outer conductor in a coaxial line or the like is extended, and a power may be supplied to the extended conductor part in order to realize easily a power feeding structure.

According to a plate-like multiple antenna of the present invention, when an inner conductor and an outer conductor in the above-described coaxial line are connected respectively for supplying a power into the above-described slot, not only a fusion connection by means of a conductive soldering material, but also use of an connector or the like may be selected dependent upon purpose of use.

According to a plate-like multiple antenna of the present invention, a position from which a power is to be supplied to the above-described slot is preferably determined by considering an impedance matching.

According to electrical equipment provided with a plate-like multiple antenna of the present invention comprises the antenna being installed inside the electrical equipment. Furthermore, according to electrical equipment provided with plate-like multiple antennas of the present invention comprises two plate-like multiple antennas being installed in such a manner that notched edges in respective plate-like conductors are not opposed to each other.

A plate-like multiple antenna according to the present invention is compact and low-profile, whereby it can be installed in even a space such as a clearance in a personal digital assistance, a cabinet for electrical appliance, a wall or the like, so that it is inexpensive and excellent in versatility.

According to a constitution of the present invention, a first monopole antenna is fabricated from a first radiation conductor, while a second monopole antenna having a direction of electric current different from that of the first monopole is fabricated from a second radiation conductor in respect to one radio wave among a plurality of radio waves applied. For this reason, high radiation efficiency can be realized, and crossed and well-balanced two monopole antennas can be realized without utilizing another earthing conductor part in a cabinet, or an earthing part of a high-frequency circuitry as a part of antenna.

Accordingly, when a plate-like multiple antenna of the present invention is installed in wireless equipment, an omnidirectional antenna can be realized with respect to the above-described one radio wave irrespective of a direction of the equipment. Furthermore, when on and after third radiation conductors are defined in a slot, a third monopole antenna different from the above-described first or second monopole antenna, or a loop antenna is formed. In this case, high radiation efficiency can be also realized, and a part of the above-described crossed structures can be used without utilizing another earthing conductor part in a cabinet, or an earthing part of a high-frequency circuitry as a part of antenna.

Hence, when a plate-like multiple antenna of the present invention is installed in wireless equipment, an omnidirectional antenna can be also realized with respect to other radio waves than the above-described one radio wave.

Besides, according to a plate-like multiple antenna of the present invention, when another antenna is disposed in the vicinity of the former antenna, a directional pattern can be controlled by varying a balance between a side being opposed to the other antenna and a side being not opposed to the other antenna so as not to arise interference with respect to the other antenna.

Thus, the antenna according to the present invention can narrow spacing for installation thereof with respect to the other antenna without missing remarkably characteristic property of antenna.

BRIEF DESCRIPTION OF THE DRAWINGS

The present invention will be explained in more detail in conjunction with appended drawings, wherein.

DESCRIPTION OF THE PREFERRED EMBODIMENT

In the following, a preferred embodiment of the present invention will be described in detail in conjunction with the accompanying drawings.

Characteristic property of a plate-like multiple antenna according to the present invention will be described by referring to FIGS. 1, 2, and 3 wherein the number of frequency band applied herein is two, and a constitutional example from which radio waves can be radiated in these frequency bands, respectively. In this respect, it is to be noted that these two frequency bands do not mean ones in which radio waves in total two frequency bands are radiated by utilizing higher harmonics of radiowave in one frequency band.

The plate-like multiple antenna according to the present invention is constituted in such that a slot 2 having a width c, and a length d, and one end of which is opened is defined on a conductor plate 1 having a width a, and a length b, and further, a first radiation conductor 3 and a second radiation conductor 4 are defined by a boundary obtained by extending the slot 2 in a longitudinal direction thereof.

Moreover, the slot 2 is defined at a position biased from the center of the conductor plate 1, and an area of the second radiation conductor 4 is made wider than that of the first radiation conductor 3.

The width a is an odd number times larger than substantially ¼ of a wavelength of either of radio waves applied. More specifically, a wavelength of a radio wave to be applied is about 120 mm in the case where a frequency of the radio wave is in 2.4 GHz band. A quarter of about 120 mm is about 30 mm, and this length is, for example, the width a of the conductor plate 1.

A wavelength of the above-described radio wave to be applied is that of electromagnetic wave to be used for communication in radio equipment having an onboard plate-like multiple antenna according to the present invention.

Furthermore, each size of a width c in the slot 2, a width e in the first radiation conductor 3, and a width f in a conductor section for linking the first radiation conductor 3 to the second radiation conductor 4 is decided in accordance with antenna characteristics requested.

Figure 2:
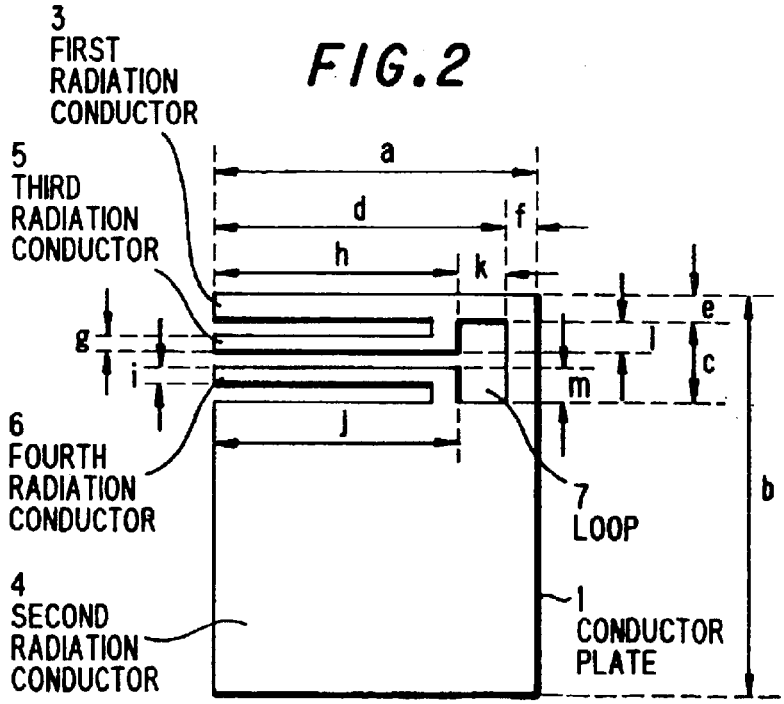
FIG. 2 is a constitutional diagram (2) showing a conductor plate used for a plate-like multiple antenna according to the present invention.

In this connection, a third radiation conductor 5 having about h+l length and g width is added from a part of the first radiation conductor 3, and a fourth radiation conductor 6 having about j+m length and i width is added from the second radiation conductor 4 into the slot 2, respectively, as shown in FIG. 2.

Thus, a length L of a loop shape 7 constituted by addition of the third radiation conductor 5 and the fourth radiation conductor 6 becomes about h+l+k+c+k+m+j.

When it is assumed that the length L of the loop shape 7 is about one wavelength and a frequency of another radio wave to be applied is 5 GHz band, a wavelength of the radio wave is about 60 mm, so that this length becomes, for example, a length of the loop shape 7.

It is to be noted that if each length and each width of a radiation conductor on and after the third one to be added does not function with respect to a radio wave to be applied, as a result of generating remarkable electrical interference between the first radiation conductor 3 and the second radiation conductor 4, it is adjusted so as to function suitably.

Moreover, the conductor plate 1 has such a constitution that it has not been connected with an external earthing section (ground) in a high-frequency manner. In this case, the expression "no high-frequency connection" means herein that a plate-like multiple antenna according to the present invention has not a conductor part, which becomes always the same potential with that of an external earthing part.

Namely, when a plate-like multiple antenna according to the present invention is loaded or housed in a manufacture cabinet, an earthing section (ground) and an earthing conductor (ground) in its equipment are not in contact with or linked directly to the conductor plate 1 itself, but they are constituted independently one another.

In reality, when a plate-like multiple antenna according to the present invention is placed in a cabinet of electrical equipment for communication represented by notebook computer or PDA, a high-frequency circuit section involved in the electrical equipment for communication is only connected electrically with the plate-like multiple antenna by means of a feeder line. The whole of a plate-like multiple antenna is covered with an insulating film such as a laminate material, or conductors around the plate-like multiple antenna are removed, whereby high-frequency connection of the plate-like multiple antenna is insulated from conductor parts or a ground section in equipment.

Figure 3:
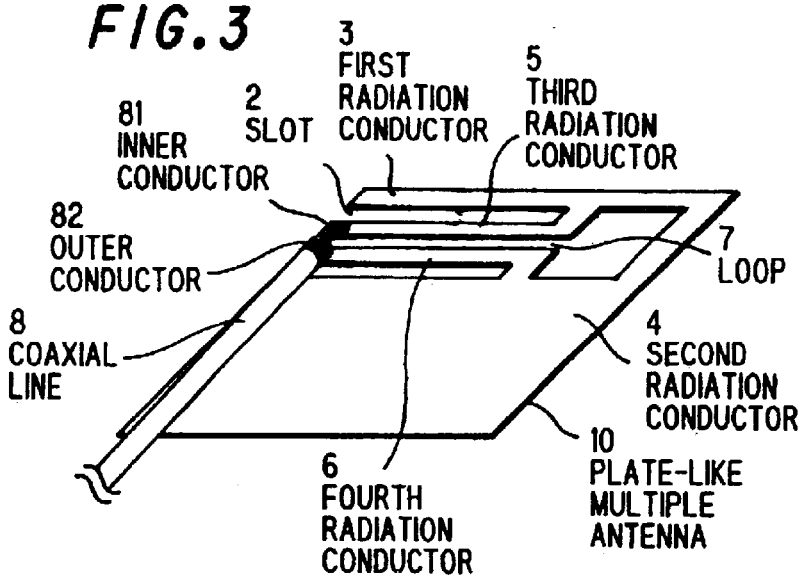
FIG. 3 is a constitutional diagram showing a plate-like multiple antenna according to the present invention.

Next, FIG. 3 constitutes a feeding structure as an example of a power feeding manner into the slot 2 in such that the third radiation conductor 5 and the fourth radiation conductor 6 are linked to a part of the first radiation conductor 3 and a part of the second radiation conductor 4, which constitute the slot 2, at a position where impedance matching has been considered, an inner radiation conductor 81 in a coaxial line 8 is connected to an end of the third radiation conductor 5, and further, an outer radiation conductor 6 in the coaxial line 8 is connected with an end of the fourth radiation conductor 6.

With respect to these connecting positions of the inner and outer conductors in the coaxial line, impedance matching is considered, and further it is considered also that radio waves in a plurality of frequency bands to be applied can be radiated, respectively.

For the connection, either fusion splicing method wherein a soldering material or the like having energizing property is used may be applied, or an exclusive connector or stay having a configuration by which energizing property can be maintained may be used.

Besides, when a feeding structure is modified as shown in the following examples, manners for feeding power such as a contact type manner, and a manner for installing type on circuit board may be also applied.

It is to be noted that the inner conductor 81 may be replaced by the outer conductor 82 in the coaxial line 8, which has been connected to the third radiation conductor 5 or the fourth radiation conductor 6.

Moreover, when either of the inner conductor 81 or the outer conductor 82 in the coaxial line 8 is connected to on and after the third radiation conductors and power is fed, their connecting positions may be freely selected dependent upon the number of radio wave to be radiated, frequency bands, and characteristic property to be intended.

Figure 4:
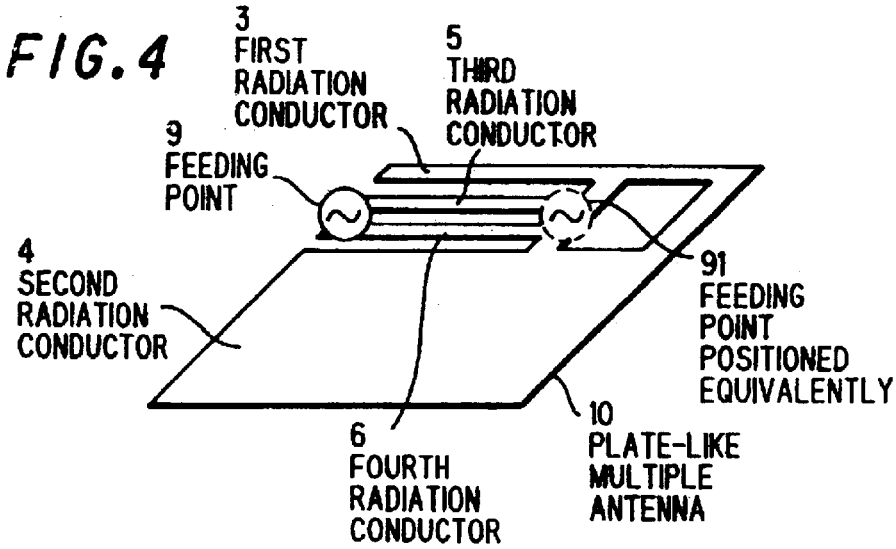
FIG. 4 is a diagram illustrating a position of feeding point in a radiated structure of a plate-like multiple antenna according to the present invention.

According to an energizing constitution as shown in FIG. 3, the third radiation conductor 5 and the fourth radiation conductor 6 function as a power feeding line to result in an equivalent arrangement wherein a feeding point has been positioned electrically at an inmost side of the slot 2 as shown in FIG. 4.

Figure 1:
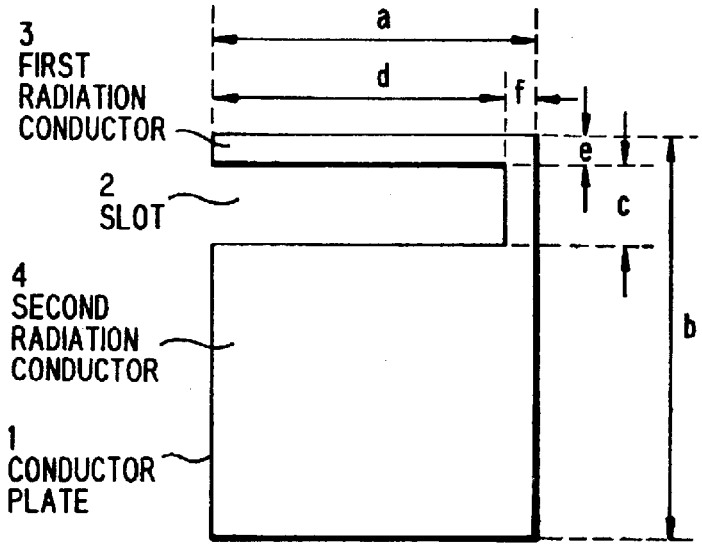
FIG. 1 is a constitutional diagram (1) showing a conductor plate used for a plate-like multiple antenna according to the present invention.

According to a constitution by which a feeding point 91 has been positioned equivalently is realized, it becomes possible to emit either of radio waves having a wavelength determining a width a of the conductor plate 1 shown in FIGS. 1 and 2.

Furthermore, the third radiation conductor 5 and the fourth radiation conductor 6 can function also as radiation conductors themselves, but not power feeding lines.

Figure 5:
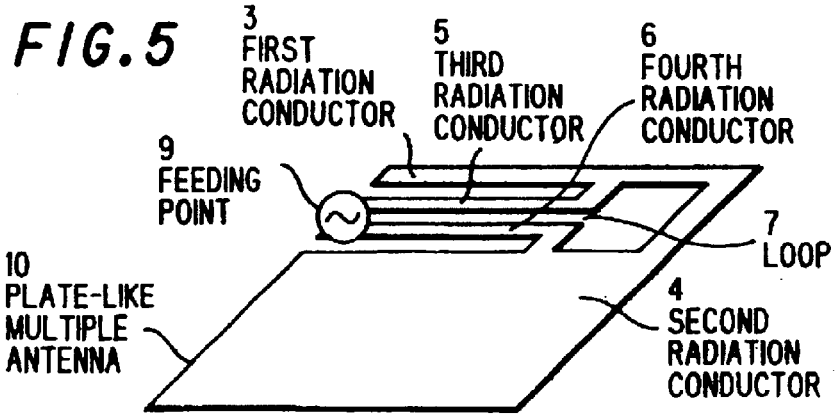
FIG. 5 is a diagram illustrating a position of feeding point in another radiated structure of a plate-like multiple antenna according to the present invention.

Namely, it becomes possible to emit either of radio waves to be applied in the loop shape 7, which is newly constituted by addition of these third and fourth radiation conductors 5 and 6 as shown in FIG. 5, and involves the feeding points 9 at respective ends of both the radiation conductors.

Although the loop shape. 7 has been constituted herein, structures other than the loop shape may be applied in response to target characteristics and the like.

As mentioned above, a structure from which two different radio waves can be radiated is finally realized.

First of all, a first radiation structure for radio wave will be described herein.

Figure 6:
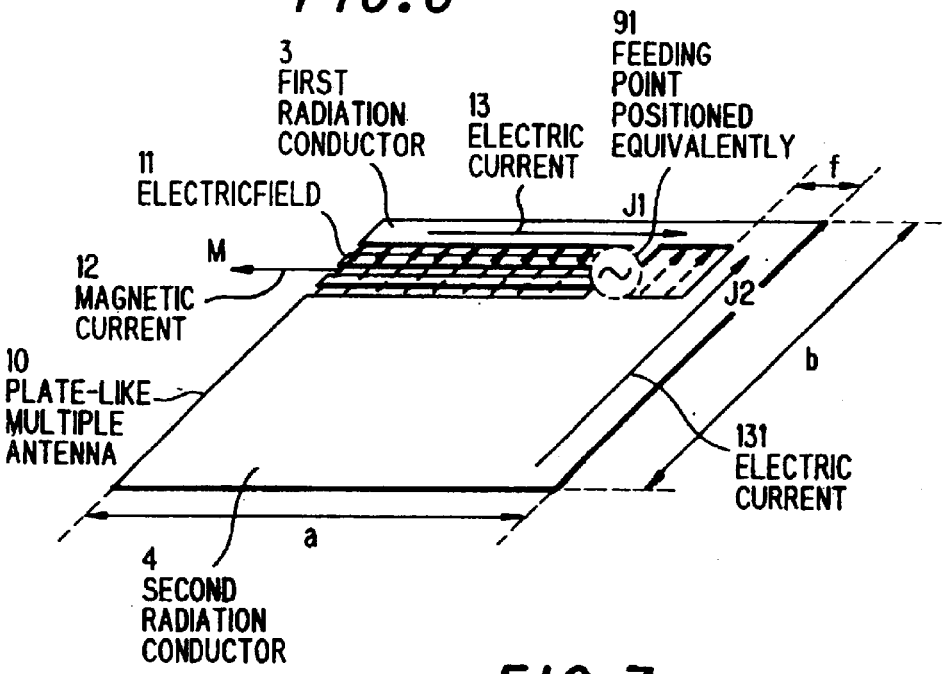
FIG. 6 is an electrical, constitutional diagram in a radiated structure of a plate-like multiple antenna according to the present invention.

As shown in FIG. 4, the third radiation conductor 5 and the fourth radiation conductor 6 function as power feeding lines, so that power can be supplied in the slot 2, whereby an electric field 11 appears between the first radiation conductor 3 and the second radiation conductor 4 opposite to each other in the slot 2 as shown in FIG. 6. As a result, magnetic current (M) 12 appears in an opening direction of the slot 2 perpendicular to the electric field 11, so that the slot 2 functions as a slot antenna.

Moreover, an electric current (J1) 13 arises in the longitudinal direction on the first radiation conductor 3, while an electric current (J2) 131 arises in the long direction (the length direction of the conductor plate 1) on the second radiation conductor 4.

Thus, each of the first radiation conductor 3 and the second radiation conductor 4 functions as a separate monopole antenna by means of these electric currents 13 and 131.

As mentioned above, a plate-like multiple antenna 10 according to the present invention constitutes electrically one slot antenna and two monopole antennas on the same conductor plate with respect to one of two radio waves to be applied.

As a result, a length of a monopole antenna (a length b of conductor plate) constituted by the electric current 131 on the second radiation conductor 4 contributes to standing wave of the electric current 131 and impedance matching of the whole plate-like multiple antenna 10, so that when a width a and a height b of the plate-like multiple antenna 13 are adjusted, a constitution by which electrical matching of the first and second radiation conductors can be decided is achieved.

Furthermore, when a width (e in FIG. 1) of the first radiation conductor 3 is adjusted, emission of power in the slot antenna due to the magnetic current (M) 12 can be adjusted in a plate-like multiple antenna according to the present invention.

In response to purposes, it becomes possible to suppress emission of power by means of the slot antenna, and to achieve a constitution wherein there is only emission of power with two monopole antennas by means of the electric current (J1) 13 and the electric current (J2) 131.

It is to be noted that a radiation structure composed of one slot antenna and two monopole antennas is hereinafter referred to as "first radiation structure".

In the following, a second radiation structure for radio wave will be described.

Figure 7:
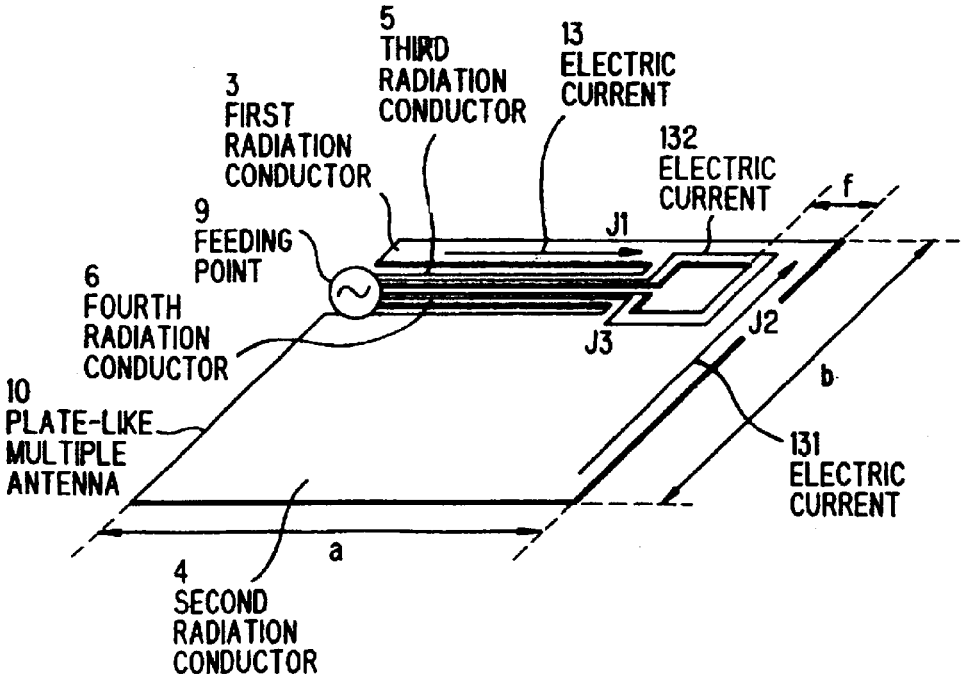
FIG. 7 is an electrical, constitutional diagram in another radiated structure of a plate-like multiple antenna according to the present invention.

As shown in FIG. 5, the third radiation conductor 5 and the fourth radiation conductor 6 become radiation elements, and function as a part of one antenna, and as shown in FIG. 7, a loop-shaped current distribution (J3) 132 is constituted by utilizing the third radiation conductor 5, and the fourth radiation conductor 6 as well as a part of the first radiation conductor 3, and a part of the second radiation conductor 4 to function as a loop antenna.

In this case, the electric current (J1) 13 appears in the longitudinal direction on the first radiation conductor 3, while the electric current (J2) 131 appears also in the long direction (the length direction of the conductor plate 1) on the second radiation conductor 4, respectively.

Hence, the first radiation conductor 3 and the second radiation conductor 4 function also as separate monopole antennas, respectively.

As mentioned above, a plate-like multiple antenna 10 according to the present invention constitutes electrically one loop antenna and two monopole antennas on the same conductor plate with respect to another of two radio waves to be applied. In this constitution, however, a monopole antenna due to the electric current 13 contributes slightly, while a length (a length b of conductor plate) of a monopole antenna constituted by the electric current 131 on the second radiation conductor 4 contributes to standing wave of the electric current 131 and impedance matching of the whole plate-like multiple antenna 13. Accordingly, such a constitution by which the loop shape 7, which is formed by the use of the third and fourth radiation conductors with the electric current 132, and electrical matching of the second radiation conductor can be decided, when a height b of the plate-like multiple antenna 10 is adjusted is also obtained.

While a case wherein the loop shape 7 is constituted has been described herein, a structure other than a loop-shaped configuration may be applied in response to target characteristic property and the like. An example of which will be described in the following specific examples.

A radiation structure, which functions as a result of adding on and after the third radiation conductors into the slot 2, is referred hereinafter to as "a second radiation structure".

Figure 8:
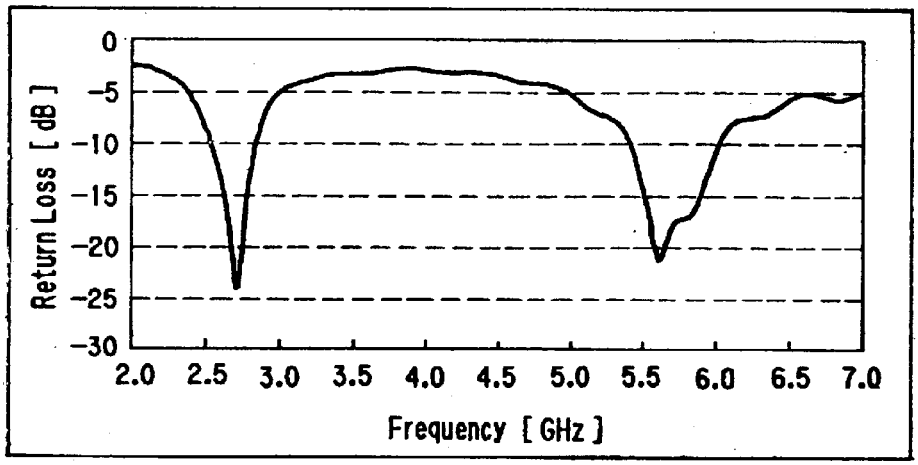
FIG. 8 is a graphical representation showing an excitation pattern of a plate-like multiple antenna according to the present invention.

Next, an excitation pattern of a plate-like multiple antenna 10 is shown in FIG. 8 wherein frequency bands of radio wave to be applied are 2.7 GHz band and 5.7 GHz band, and a conductor plate having 0.2 mm thickness is used for a plate-like multiple antenna having each dimension of a=30 mm, b=30 mm, c=4 mm, d=28 mm, e=1 mm, f=2 mm, g=1 mm, h=15 mm, i=3 mm, and j=k=1.75 mm in response to wavelengths of radio wave in the respective frequency bands. These dimensions correspond to respective radio waves in 2.7 GHZ band in the first radiation structure, and 5.7 GHz band in the second radiation structure.

With respect to first radiation structure, a constitutional example wherein emission of electric power due to a slot antenna is suppressed, and an electric power is emitted by means of two monopole antennas.

On the other hand, an electrical connection among the third and fourth radiation conductors 5, 6 and the first and second radiation conductors 3, 4 is taken into consideration, so that a smaller structure is made with respect to the second radiation structure.

Figure 9:
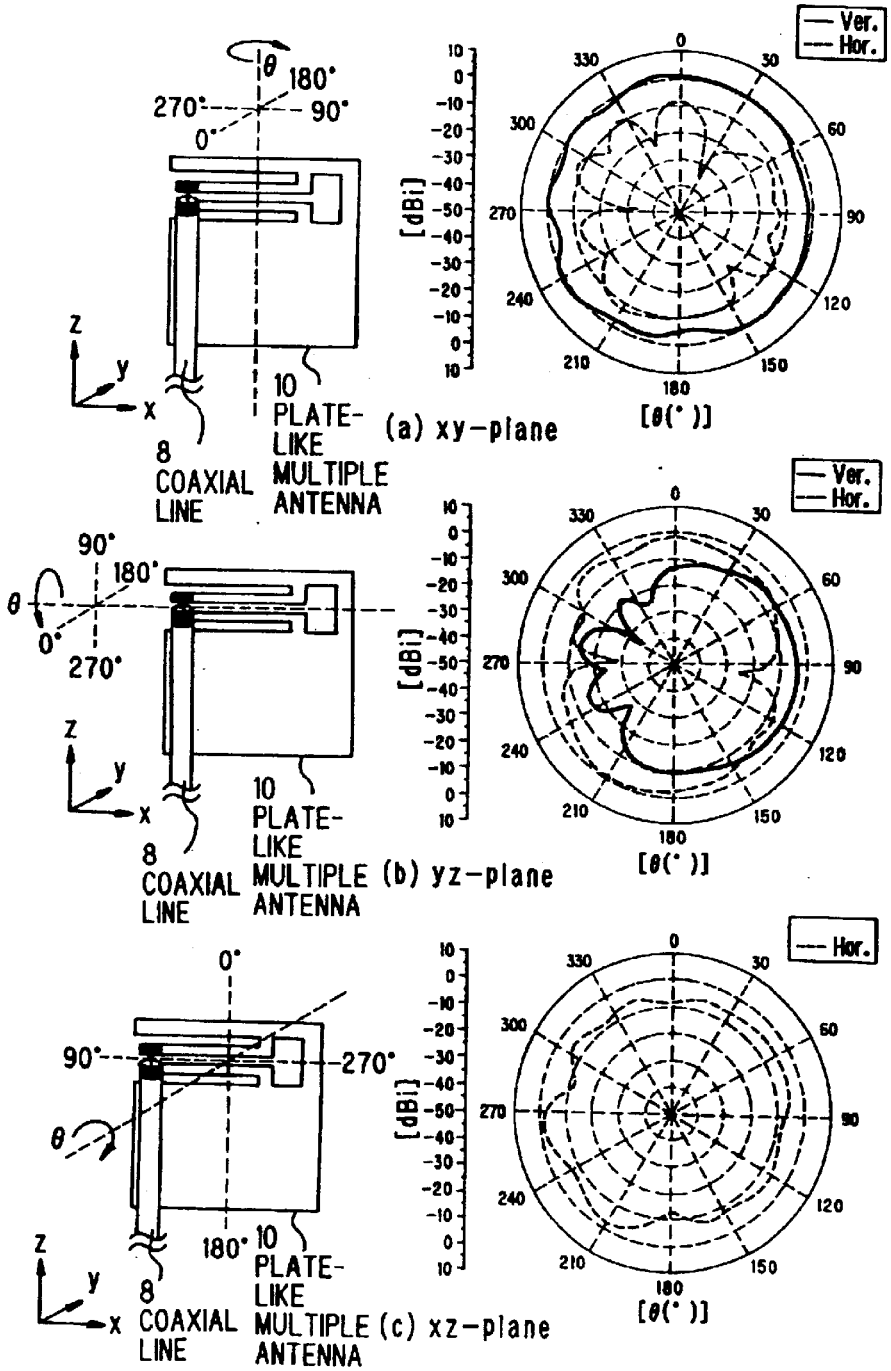
FIGS. 9(*a*), 9(*b*), and 9(*c*) are diagrams each showing a directional pattern in a radiated structure of a plate-like multiple antenna according to the present invention.

Moreover, power feed to the plate-like multiple antenna 10 is made by the use of a thin diameter coaxial cable having 0.8 mm diameter, which has been connected by soldering in accordance with a manner shown in FIG. 3. In this case, an excitation pattern is that as shown in FIG. 8 wherein a value two or less of VSWR (voltage standing wave ratio) (return loss: about −10 dB or less) in frequency bands of two radio waves to be applied is realized in broad band. Next, a directional pattern of a structure shown in FIG. 8 is shown in FIGS. 9(*a*), 9(*b*), 9(*c*) and FIGS. 10(*a*), 10(*b*), 10(*c*) wherein FIGS. 9(*a*), 9(*b*), and 9(*c*) show results in 2.7 GHz band (the first radiation structure), while FIGS. 10(*a*), 10(*b*), and 10(*c*) show results in 5.7 GHz band (the second radiation structure), respectively.

In both the above figures, a plate-like multiple antenna 10 according to the present invention is in a state wherein the antenna is placed on yz-plane of coordinate system in which (a) indicates a directional pattern in xy-plane as a result of rotating z-axis, (b) indicates a directional pattern in yz-plane as a result of rotating x-axis, and (c) indicates a directional pattern in xz-plane as a result of rotating y-axis, all of them being divided into a horizontally polarized wave (Hor.) and a vertically polarized wave (Ver.), respectively.

First, FIGS. 9(*a*), 9(*b*), and 9(*c*) will be described. In these figures, a horizontally polarized wave due to the electric current J1 and a vertically polarized wave due to the electric current J2 of FIG. 6 (the first radiation structure) appear in the xy-plane of FIG. 9(*a*); further, a vertically polarized wave due to the electric current J1 and a horizontally polarized wave due to the electric current J2 of FIG. 6 appear in the yz-plane of FIG. 9(*b*); and a horizontally polarized wave due to the electric currents J1 and J2 of FIG. 6 appears in the xz-plane of FIG. 9(*c*).

From the results shown in the respective figures, it has been found that good transmission-reception characteristics can be realized with accompanying no null point in combination of horizontally polarized wave and vertically polarized wave in omnidirection of all the planes, xy-, yz-, and xz-planes by the first radiation structure of the plate-like multiple antenna 10 according to the present invention. (Although there are null points, when viewed individually the horizontally polarized waves and the vertically polarized waves, these null points disappear when viewed both the horizontally polarized and vertically polarized waves in combination of them.)

Next, FIGS. 10(*a*), 10(*b*), and 10(*c*) will be described. In these figures, a horizontally polarized wave due to the electric current J3 and a vertically polarized wave due to the electric. currents J2 and J3 of FIG. 7 (the second radiation structure) appear in the xy-plane of FIG. 10(*a*); further, a vertically polarized wave due to the electric current J3 and a horizontally polarized wave due to the electric currents J2 and J3 of FIG. 7 appear in the yz-plane of FIG. 10(*b*); and a horizontally polarized wave due to the electric currents J2 and J3 of FIG. 7 appears in the xz-plane of FIG. 10(*c*).

From the results shown in the respective figures, it has been found that good transmission-reception characteristics can be realized also with accompanying no null point in combination of horizontally polarized wave and vertically polarized wave in omnidirection of all the planes, xy-, yz-, and xz-planes by the second radiation structure of the plate-like multiple antenna 10 according to the present invention.

On the other hand, it has been known that a good directional pattern cannot be realized by the well-known antennas mentioned hereinabove with respect to omnidirection of all the planes in view of their constitution unlike the plate-like multiple antenna 10 of the present invention.

While radio waves in a frequency band in which harmonic components arise can be multiplexed, but such multiplexing wherein a plurality of target frequency bands have been fixed cannot be implemented unlike the plate-like multiple antenna 10 of the present invention.

Figure 10:
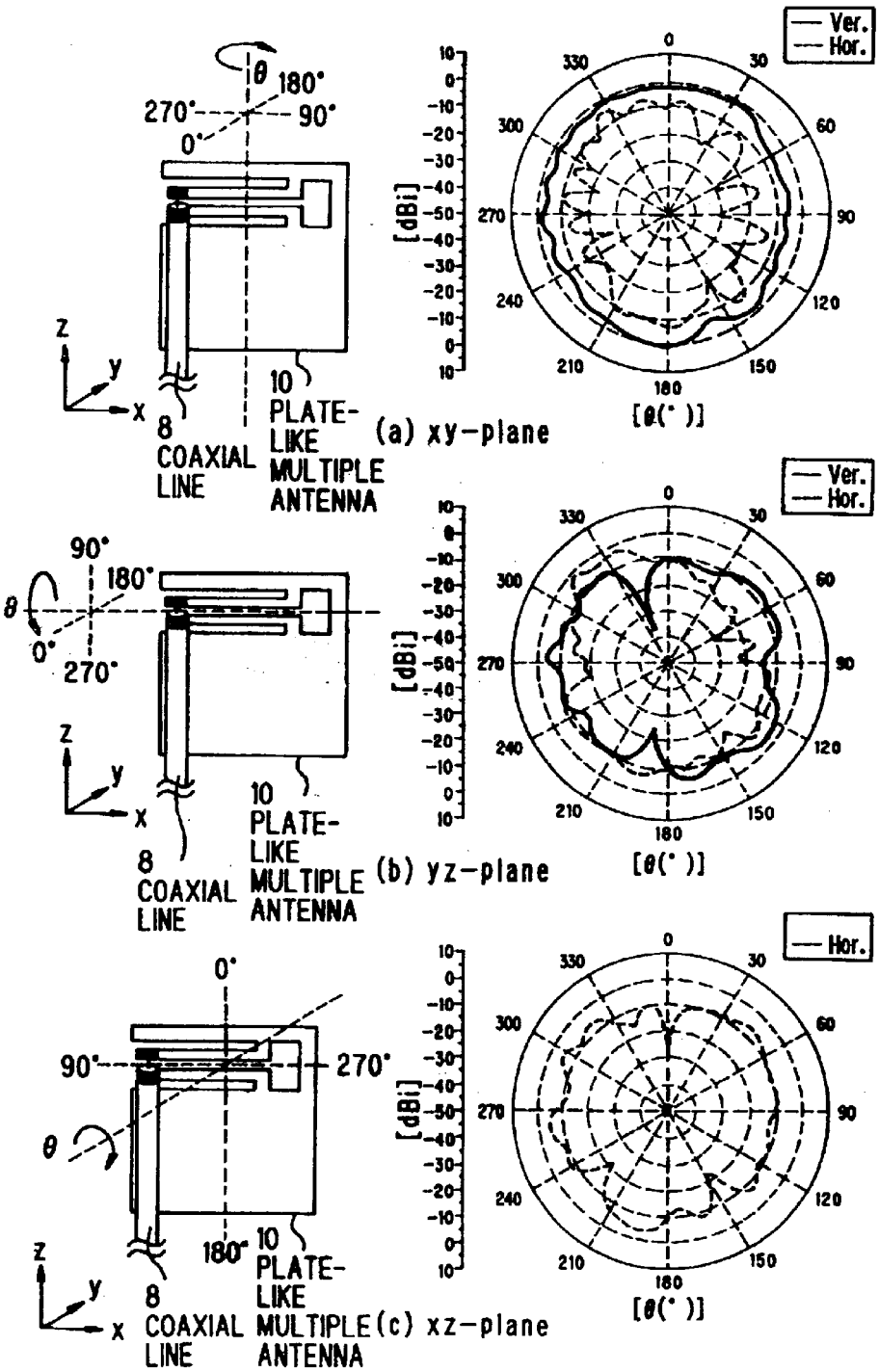
FIGS. 10(*a*), 10(*b*), and 10(*c*) are diagrams each showing a directional pattern in another radiated structure of a plate-like multiple antenna according to the present invention.

Moreover, it is also possible that the directional pattern of FIGS. 9(*a*), 9(*b*), and 9(*c*) as well as FIGS. 10(*a*), 10(*b*), and 10(*c*) are inclined so as to match with intended purposes by adjusting either a width a or a length b in a plate-like multiple antenna 10 with respect to a length (d in FIG. 1) of a slot. In this respect, the details therefor are described in examples of the present invention, which will be described later.

In case of the preferred embodiment of the present invention, a direction of the electric current 13 has been parallel with respect to a direction of the magnetic current 12, and a direction of the electric current 131 has been perpendicular thereto in the first radiation structure as shown in FIG. 6. However, when a conductor part for joining the first radiation conductor to the second radiation conductor, which are defined on the border of a region extended in a longitudinal direction from the slot 2, is formed in an inclined fashion, the electric current 131 flows along the conductor part, so that a direction of the magnetic current 12 comes to be not perpendicular to that of the electric current 131.

Figure 11:
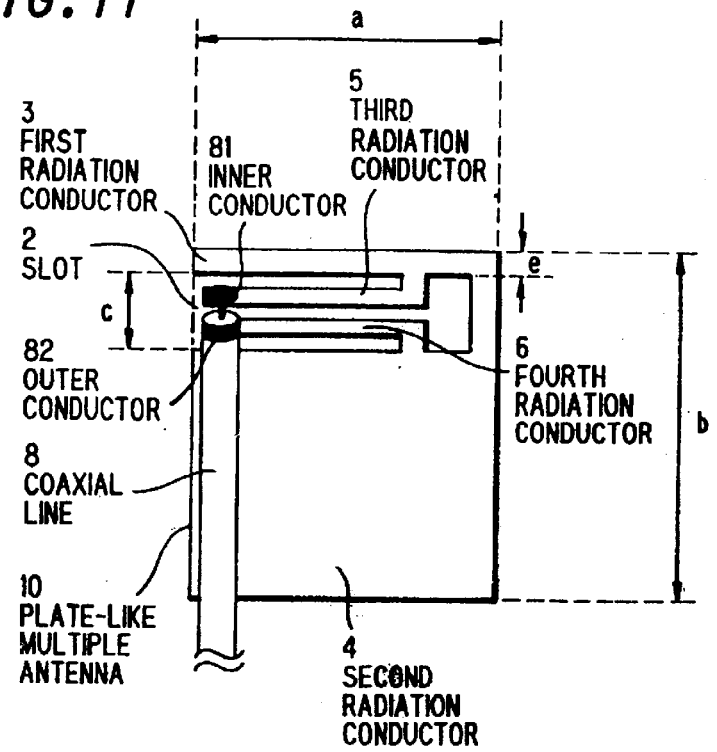
FIG. 11 is constitutional diagram showing a plate-like multiple antenna according to the present invention.
Figure 12:
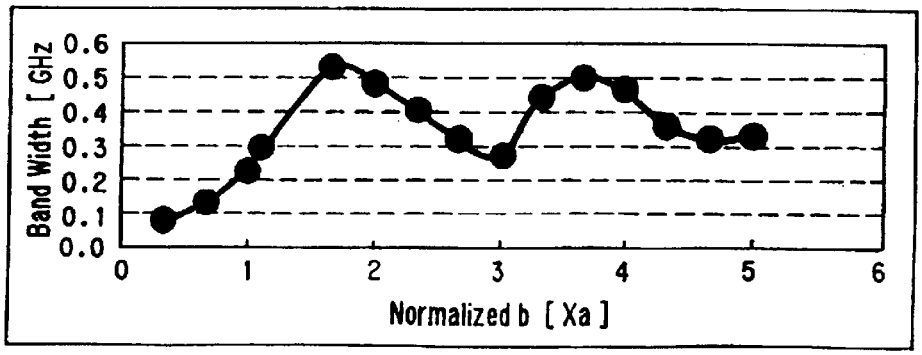
FIG. 12 is a diagram showing bandwidths in a radiated structure with changes in a plate-like multiple antenna constitution according to the present invention.
Figure 13:
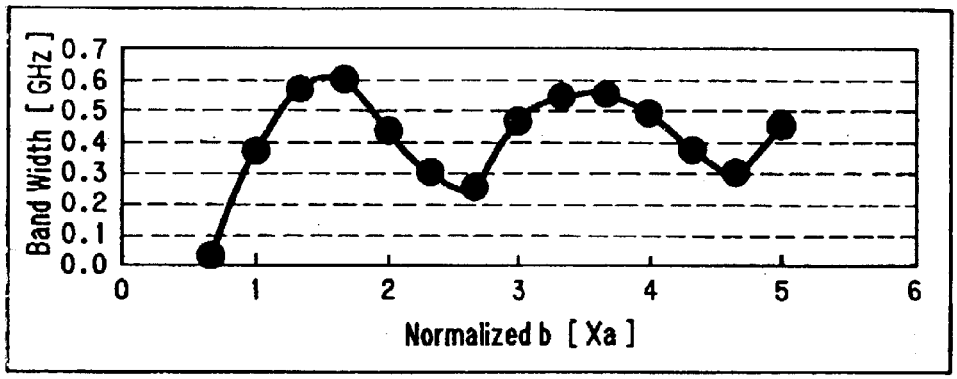
FIG. 13 is a diagram showing bandwidths in the radiated structure with changes in a plate-like multiple antenna constitution according to the present invention.

Next, for the sake of indicating characteristic property of changes in band width due to electrical matching of the first radiation conductor with the second radiation conductor, which constitute the first radiation structure of a plate-like multiple antenna 10 according to the present invention, changes in a band width [VSWR (voltage standing wave ratio) two or less] in the first radiation structure in the case when a length b of the plate-like multiple antenna 10 of FIG. 11 is changed are shown in FIGS. 12 and 13.

First, in the constitution of FIG. 11, a width e of a first radiation conductor 3 and a width c of a slot 2 are fixed, a position at which a third radiation conductor 5 is linked to the first radiation conductor 3 is fixed, and further a position at which a fourth radiation conductor 6 is linked to a second radiation conductor 4 is fixed. Furthermore, an end of the third radiation conductor 5 is connected with an inner conductor 81 of a coaxial line 8, an outer conductor 82 of the coaxial line 8 is connected with an end of the fourth radiation conductor 6, and these connected positions are also fixed. Under the above-described fixed conditions, changes in band width in the case when a length b of the plate-like multiple antenna 10 is changed are indicated in FIG. 12.

From the results indicated in FIG. 12, it has been found that the band width oscillates periodically to occur changes in the first radiation structure. This phenomenon is derived from an effect due to changes in standing wave of the electric current (J2) 131 shown in FIG. 6.

However, it is observed from the results indicated in FIG. 12 that peak frequency in excitation shifts also by means of changes in impedance in accordance with the changes in standing wave.

Accordingly, the linked position of the third radiation conductor 5 and the first radiation conductor 3 as well as the linked position of the fourth radiation conductor 6 and the second radiation conductor 4 are adjusted in accordance with changes in the length b of the plate-like multiple antenna 10, while a peak frequency in excitation of the first radiation structure is fixed. Evaluated results obtained in the above-described conditions are indicated in FIG. 13.

From FIG. 13, it has been found that band width oscillates to occur changes as in the case of FIG. 12, besides they are periodical changes. This characteristic property is also an effect derived from changes in standing wave of the electric current (J2) 131 shown in FIG. 6.

With respect to the second radiation structure, an oscillating frequency in a characteristic curve is different, but the same results as those of FIGS. 12 and 13 are obtained.

Figure 14:
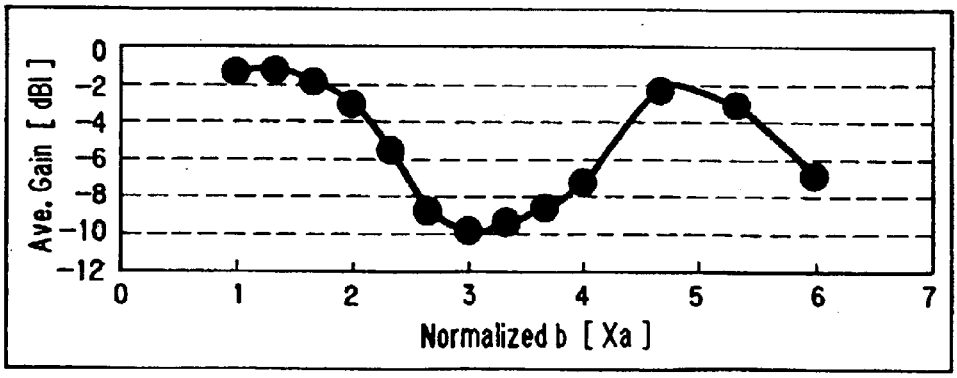
FIG. 14 is a diagram showing average radiation gains in a radiated structure with changes in a plate-like multiple antenna constitution according to the present invention.
Figure 15:
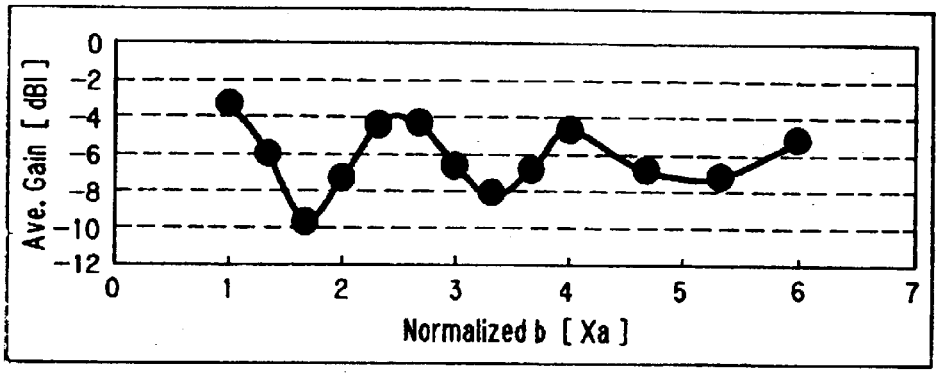
FIG. 15 is a diagram showing average radiation gains in another radiated structure with changes in a plate-like multiple antenna constitution according to the present invention.

In order to indicate characteristics of changes in average radiation gain due to electrical matching of the second radiation conductor in a plate-like multiple antenna 10 according to the present invention, changes in average radiation gain in the first radiation structure and the second radiation structure in the case when a length b of the plate-like multiple antenna 10 of the present invention shown in FIG. 11 are indicated in FIGS. 14 and 15, respectively.

FIG. 14 shows a case of the first radiation structure wherein radio wave having frequency 2.7 GHZ band is emitted as in the case of FIGS. 9(*a*), 9(*b*), and 9(*c*).

On one hand, FIG. 15 shows a case of the second radiation structure wherein radio wave having frequency 5.7 GHz band is emitted as in the case of FIGS. 10(*a*), 10(*b*), and 10(*c*).

From the results indicated in FIGS. 14 and 15, it has been found that the average radiation gains change periodically in both the frequency bands in the plate-like multiple antenna 10 according to the present invention with changes in the length b thereof.

This phenomenon is an effect derived from changes in standing wave of the electric current (J2) 131 shown in FIGS. 6 and 7 as mentioned relating to FIGS. 12 and 13, and further, it means that excitation state and radiation intensity in the respective frequency bands are determined by the length b of the antenna 10.

Furthermore, although cycles of oscillation differ from one another in both the cases, this is because there are differences in frequency bands in both the cases.

From the results as described above, it has been found that an average radiation gain can be set so as to match an intended purpose by adjusting a size of a plate-like multiple antenna 10 according to the present invention.

Based on the above-described results, it has been found that there is such a constitution that the plate-like multiple antenna 10 of the present invention can decide easily a band width, and it can decide also average radiation gain by utilization of electrical matching thereof with respect to the first and second radiation conductors in the first radiation structure as well as of electrical matching thereof with respect to the second radiation conductor in also the second radiation structure.

It is to be understood that there is a case where the results shown in FIGS. 12 through 15 somewhat differ from one another dependent upon frequencies of radio waves applied, and sizes of antenna themselves to be used, but fundamental characteristic property does not differ.

Figure 16:
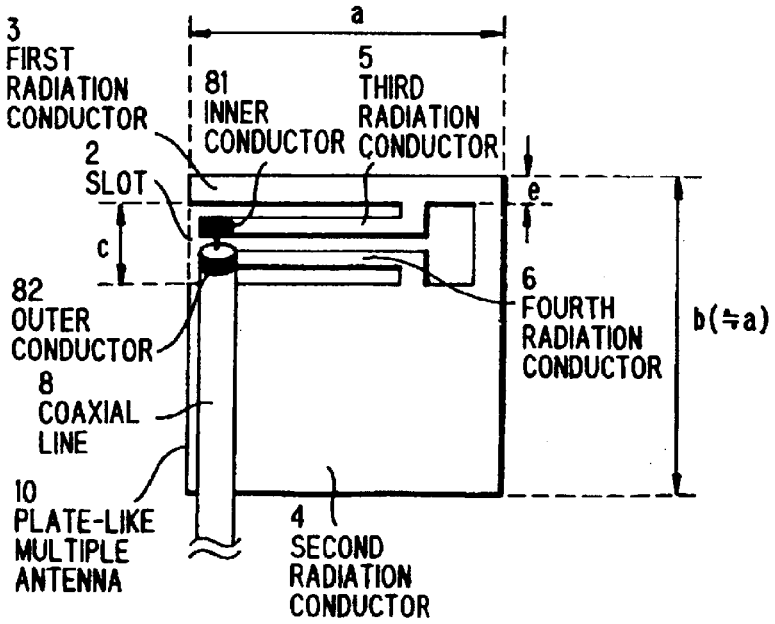
FIG. 16 is a constitutional diagram showing a plate-like multiple antenna according to the present invention.
Figure 17:
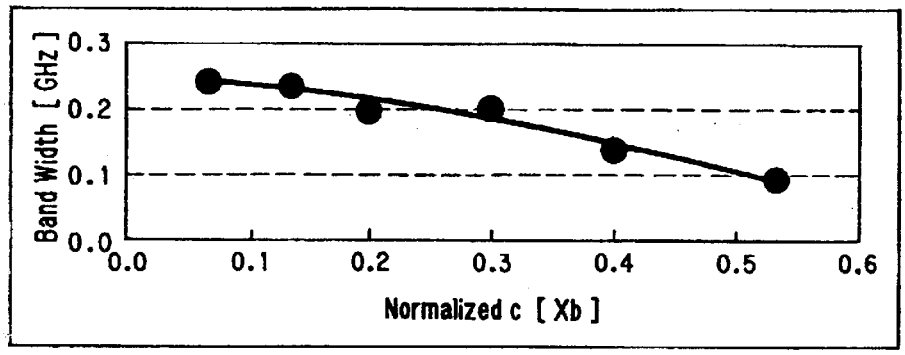
FIG. 17 is a diagram showing bandwidths in a radiated structure with changes in a plate-like multiple antenna constitution according to the present invention.
Figure 18:
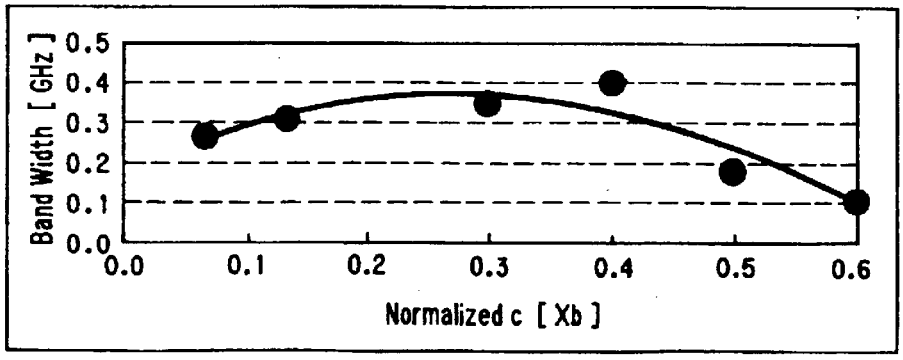
FIG. 18 is a diagram showing bandwidths in a radiated structure with changes in a plate-like multiple antenna constitution according to the present invention.

In order to exhibit characteristics in changes of band width based on a slot width c in the first radiation structure of the plate-like multiple antenna 10 of the present invention, changes in band width [VSWR (voltage standing wave ratio) two or less] in the case when a width c of a slot 2 in the plate-like multiple antenna 10 of the present invention shown in FIG. 16 is varied are indicated in FIG. 17 and FIG. 18.

With reference to the second radiation structure, since the structure is constituted in such that it is to be contained in the slot 2, the evaluation results thereof are omitted herein.

First, in the constitution shown in FIG. 16, a width e of a first radiation conductor 3 is fixed, a position at which a third radiation conductor 5 is linked to the first radiation conductor 3, and further, a position at which a fourth radiation conductor 6 is linked to a second radiation conductor is also fixed. Besides, an end of the third radiation conductor 5 is connected with an inner conductor 81 in a coaxial line 8, an outer conductor 82 in the coaxial line 8 is connected with an end of a fourth radiation conductor 6, and these connected positions are also fixed. Under the above-described fixed conditions, changes in band width in the first radiation structure in the case when a width c in the slot 2 of the plate-like multiple antenna 10 is varied are indicated in FIG. 17.

In this case, a width a is equivalent to a length b in the plate-like multiple antenna 10 of the present invention, and a size thereof is determined by serving a good result in FIG. 13 as a reference.

From the results indicated in FIG. 17, it has been found that band width becomes narrow with increase in the width c of the slot 2.

However, it has been found from experiments that changes in impedance of FIG. 17 are more remarkable than that of FIG. 12, so that a displacement of peak frequency in excitation is also remarkable with changes in the width c of the slot 2.

For this reason, the position for connecting the third radiation conductor 5 with the first radiation conductor 3 as well as the position for connecting the fourth radiation conductor 6 with the second radiation conductor 4 are further adjusted with changes in the width c of the slot 2, besides the peak frequency in excitation is fixed. In this condition, evaluation is made to obtain results, and they are indicated in FIG. 18.

From the results indicated in FIG. 18, it has been found that changes in band width decrease with respect to increase in the width c of the slot 2.

Moreover, it has been also found that even if the width c of the slot 2 comes to be around half of a length b of the plate-like multiple antenna 10 of the present invention, a corresponding band is maintained.

Namely, it has been found that the plate-like multiple antenna 10 of the invention has a structure by which maintenance of a corresponding band can be easily realized due to electrical matching of the first radiation conductor with the second radiation conductor, even if the width c of the slot 2 is broaden.

It is to be understood that there is a case where the results shown in FIGS. 17 and 18 somewhat differ from one another dependent upon frequencies of radio waves applied, and sizes of antenna themselves to be used, but fundamental characteristic property does not differ.

In the present preferred embodiment, although a frequency band has been 2.7 GHz in the first radiation structure, and 5.7 GHz in the second radiation structure, a plate-like multiple antenna according to the present invention can respond to any frequency band in principle so far as its conductor has a width a, which corresponds to about ¼ of a wavelength of one radio wave among plural radio waves applied.

Moreover, when a second radiation structure can be realized by constituting on and after a third radiation conductor with respect to each of the other radio waves so as to be contained in its slot in response to its wavelength, the plate-like multiple antenna can respond to any frequency band in principle in this case.

From the respective results indicated in FIGS. 12, 13, 14, 15, 17 and 18, it has been found that a plate-like multiple antenna 10 according to the present invention has such an antenna structure by which maintenance of a useful band width can be easily realized, even if there are somewhat changes in its constitution so far as the following conditions are held.

Namely, the conditions are such that a size of the plate-like multiple antenna 10 is determined so as to maintain electrical matching thereof with the first and second radiation conductors in the first radiation structure, the size is further determined so as to maintain also electrical matching thereof with the second radiation conductor in the second radiation structure, and a power feeding position in a slot is considered with respect to the first radiation structure and the second radiation structure.

When effects, which are apparent from the above results, are further combined with each other, the resulting structure exhibits high degree of freedom in determination of structure, besides it can respond easily to a space for installation.

Furthermore, either end of a coaxial line is connected to a power supply circuit or an interchange circuit involved separately in a product housing the plate-like multiple antenna of the present invention to afford a function for power feeding line, whereby a plate-like multiple antenna, which is compact, thin-modeled, and highly general-purposed, and has high degree of freedom for installation can be realized.

In addition, since a coaxial line is used as a power feeding line, such power feeding line may be freely routed inside its main body in such that the power feeding line does not form an obstacle to other equipment and the like disposed inside the product.

As described above, according to the present invention, such a multiple antenna, which is no remarkable alteration is required with respect to a specification for personal digital assistance, product cabinet of home electric appliances for wireless network in home, positions for installing a variety of parts and the like; and further which can be housed in a space of substantial gap in a cabinet; besides which is inexpensive and assures good performance, can be realized.

Furthermore, when the above-described plate-like multiple antenna is installed inside personal digital assistance, or a product cabinet of home electric appliances for wireless network in home, such advantages that troubles such as detachment of an external antenna, reinstallation and readjustment therefor, routing for cables and the like, antenna accident in unexpected troubles, by which users have been always annoyed in case of moving such articles of manufacture, can be eliminated, and that a degree of freedom in selection can be broaden with respect to positions for installing the articles of manufacture can be achieved, because of good characteristic property involved in the present invention.

EXAMPLES

In the following, examples of the present invention will be described in conjunction with the respective accompanying drawings.

Example 1

Figure 19:
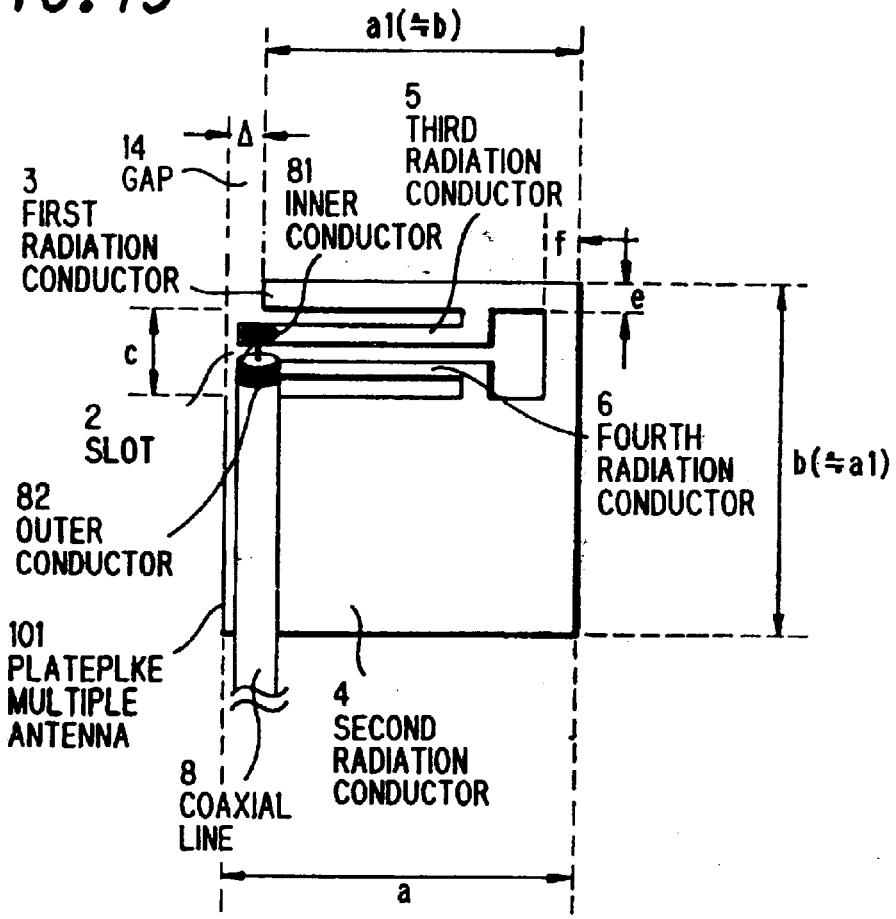
FIG. 19 is a constitutional diagram showing a plate-like multiple antenna according to example 1 of the present invention.
Figure 20:
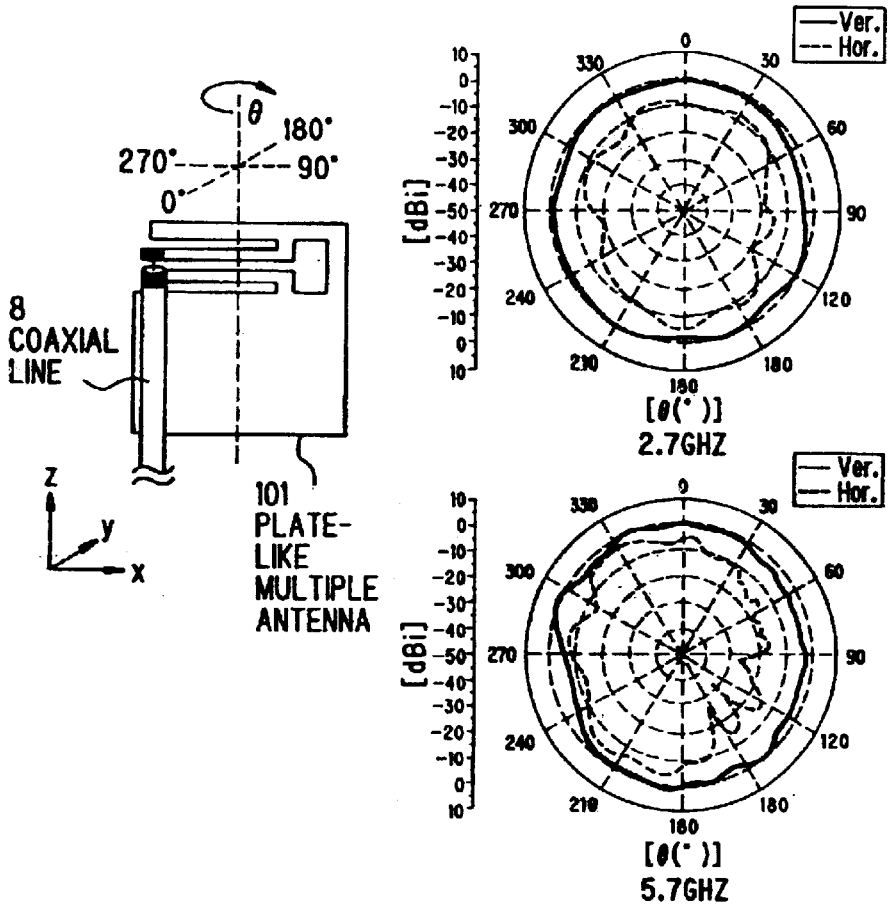
FIG. 20 is a diagram showing a directional pattern of a plate-like multiple antenna according to example 1 of the present invention.

A first example of the present invention is described by referring to FIGS. 19, 20, and 2l wherein FIG. 19 shows a constitution, which uses a plate-like multiple antenna 101 according to the present invention obtained from the constitution of FIG. 14 as its basic model, wherein a first radiation conductor 3 has a length a1 obtained by adding a length d of a slot 2 to a width f of a conductor part joining the first radiation conductor 3 to a second radiation conductor 4, the length al of the first radiation is made to be substantially the same as that of a length b of the plate-like multiple antenna, and a width a of the plate-like multiple antenna is made to be wider than the length a1.

In this case, the length a1 is made to be about ¼ of a wavelength of one radio wave among a plurality of radio waves applied.

As shown in FIG. 19, since there is a portion 14 of difference Δ (hereinafter defined and referred to as "gap")

defined between the length a1 and the width a of the plate-like multiple antenna 101, electromagnetic field appeared in the slot 2 takes its own matching, so that the electromagnetic field inclines in response to a dimension of the gap 14.

Thus, when there is no gap 14, a directional pattern as shown in FIG. 9 appears in a first radiation structure (emitting radio wave of frequency 2.7 GHz band), while it becomes possible in the present example that a directional pattern in the first radiation structure (emitting radiowave of frequency 2.7 GHz band) is allowed to shift in a direction where the gap 14 exists as shown in FIG. 20.

Furthermore, in a second radiation structure (emitting radio wave of frequency 5.7 GHz band), a directional pattern being the same as that of FIG. 10 is observed.

Figure 21:
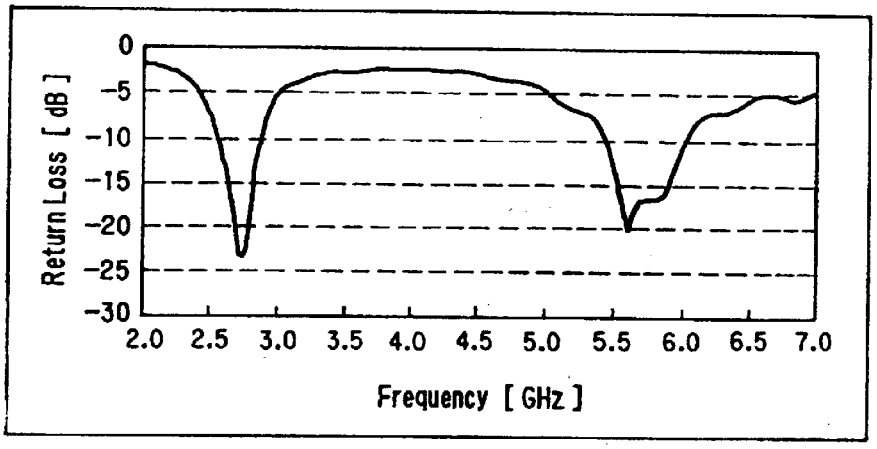
FIG. 21 is a graphical representation indicating an excitation pattern of a plate-like multiple antenna according to example 1 of the present invention.

This means that the first radiation structure functions independently from the second radiation structure. Further, an excitation pattern in this case is as shown in FIG. 21, whereby a useful broad band can be obtained.

Besides, when an extent Δ of the gap 14 is manipulated, a directional pattern in the first radiation structure of FIG. 20 can be further shifted.

Example 2

Figure 22:
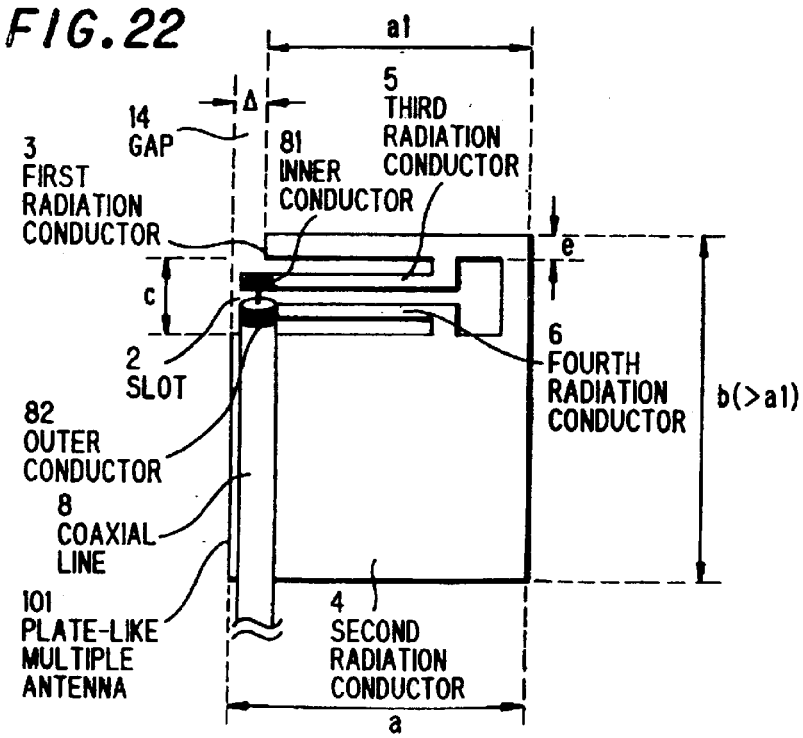
FIG. 22 is a constitutional diagram showing a plate-like multiple antenna according to example 2 of the present invention.
Figure 23:
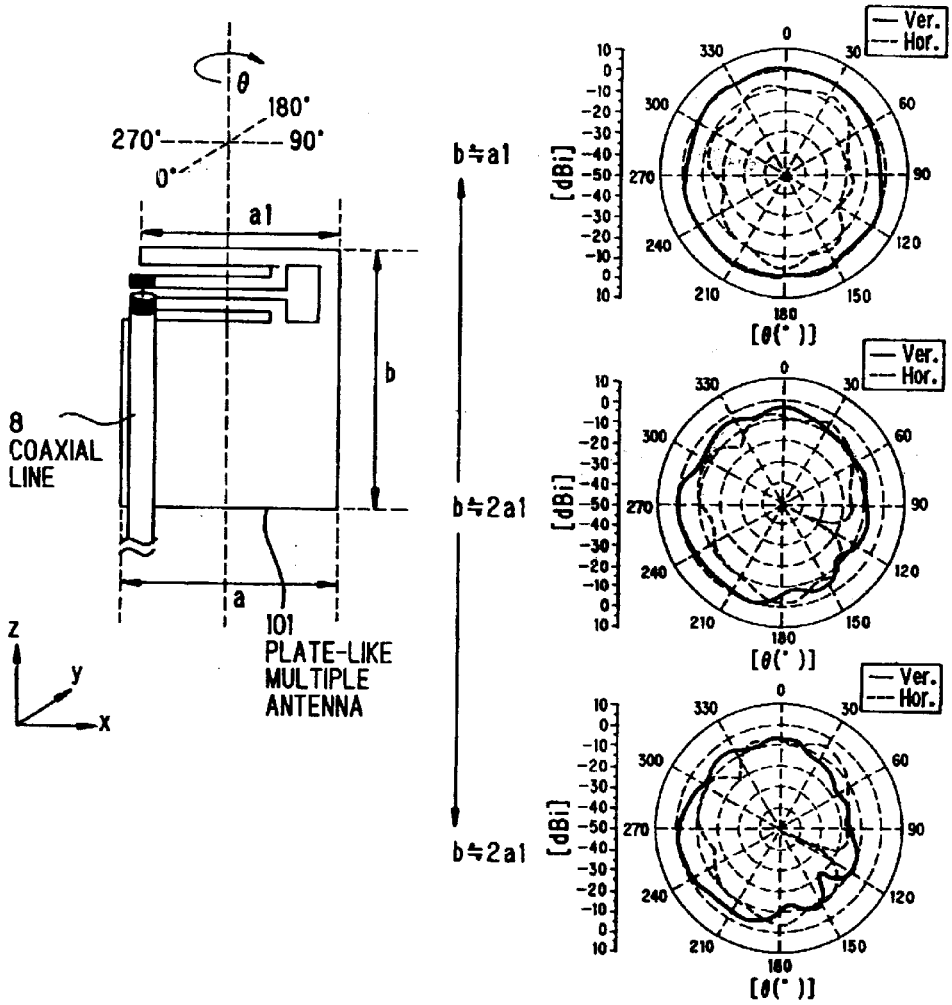
FIG. 23 is a diagram showing a directional pattern in a radiated structure of a plate-like multiple antenna according to example 2 of the present invention.
Figure 24:
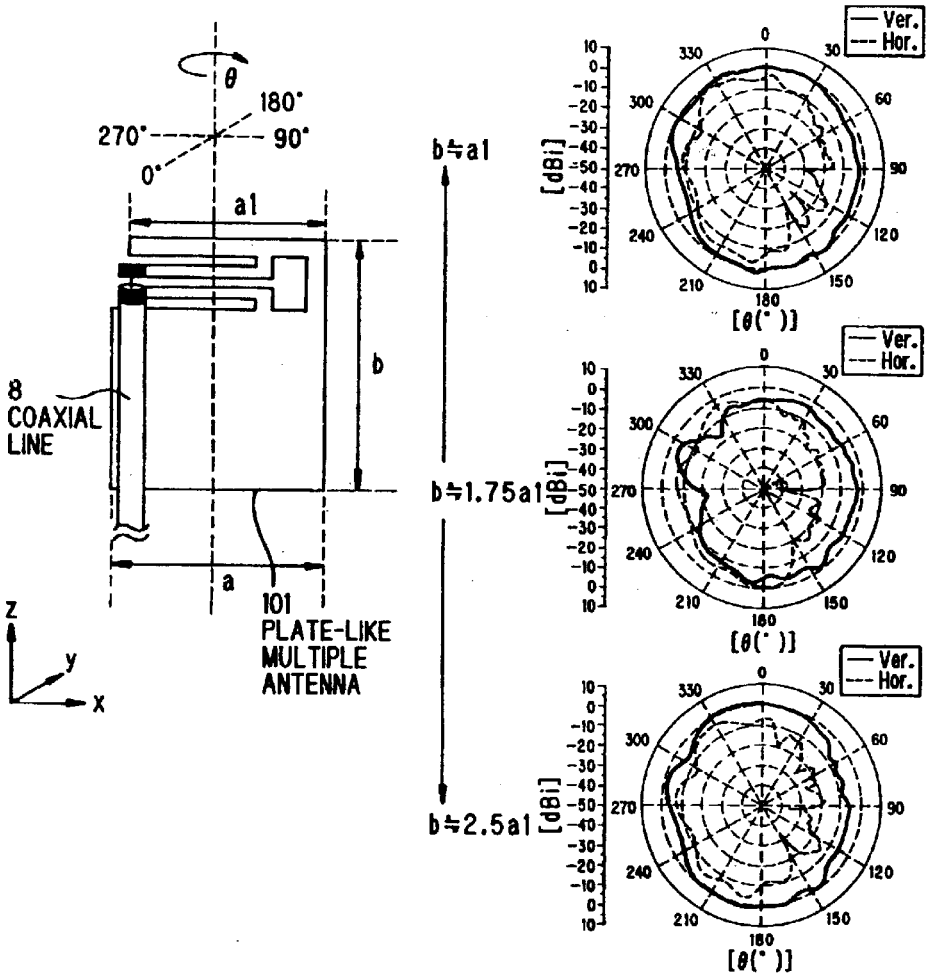
FIG. 24 is a diagram showing a directional pattern in another radiated structure of a plate-like multiple antenna according to example 2 of the present invention.

A second example of the present invention is described by referring to FIGS. 22, 23, and 24 wherein FIG. 22 shows an example in which a dimension of the gap 14 is fixed, and only the length b in the plate-like multiple antenna 101 is changed in the example 1. In this case, a standing wave in the electric current (J2) 131 shown in FIG. 6 varies with changes in the length b of the plate-like multiple antenna 101, whereby it becomes possible that an electromagnetic field component in the first radiation structure, which is inclined in the slot 2 due to the gap 14, is much more inclined.

Hence, it has been found as shown in FIG. 23 that a directional pattern in the first radiation structure may be shifted in a direction where a gap 14 exists as in the case of example 1, and further a directional pattern in the first radiation structure can be suppressed in a direction where there is no gap 14.

Moreover, it has been found that a directional pattern in the second radiation structure is as shown in FIG. 24, and that the magnitude of distribution shown in FIGS. 10(*a*), 10(*b*), and 10(*c*) varies with changes in a length b of the plate-like multiple antenna 101 in response to the cycle of FIG. 15.

As described above, it is possible that a directional pattern of a plate-like multiple antenna 101 according to the present invention is controlled by means of the length b.

In this case, a useful broad band could have been obtained in its excitation pattern as in example 1, but indication therefor is omitted herein.

Example 3

Figure 25:
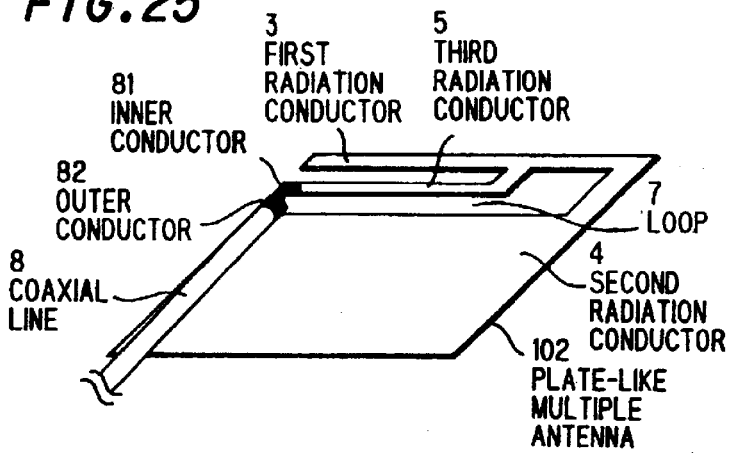
FIG. 25 is a perspective view showing a plate-like multiple antenna according to example 3 of the present invention.
Figure 26:
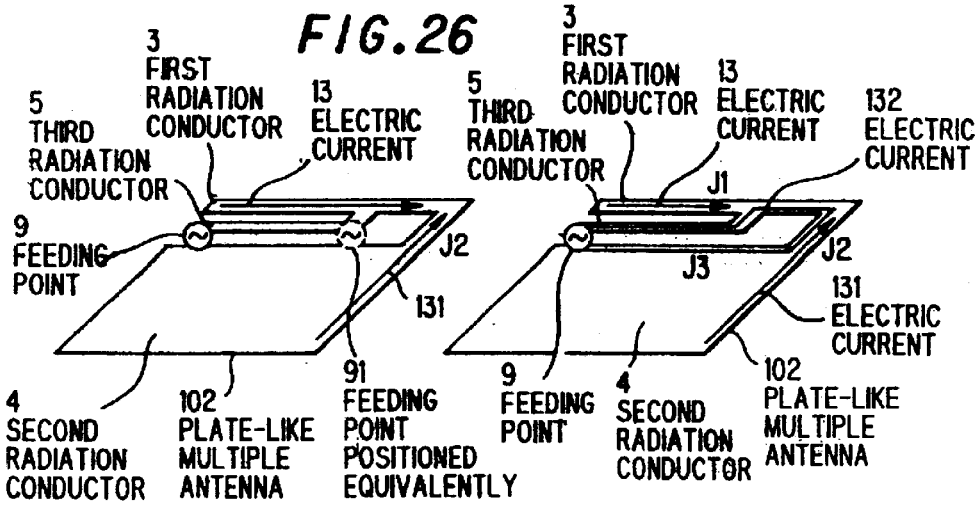
FIG. 26 is an electrical constitutional diagram showing a plate-like multiple antenna according to example 3 of the present invention.

A third example of the present invention is described in conjunction with FIGS. 25 and 26 wherein FIG. 25 shows a constitution of a plate-like multiple antenna 102 according to the present invention in the case where a third radiation conductor 5 is added to a part of a first radiation conductor 3, a part of the third radiation conductor 5 is connected with an inner conductor 81 of a coaxial line 8, and further, apart of a second radiation conductor 4 is connected with an outer conductor 82 of the coaxial line 8, whereby power supply is implemented.

It is to be understood that these connecting positions are determined with taking constitutions of the first radiation structure and the second radiation structure by which radio waves in a plurality of frequency bands applied can be emitted as well as impedance matching of an antenna into consideration.

More specifically, a position at which the inner conductor 81 in the coaxial line 8 is to be connected with a part of the third radiation conductor 5 is not necessarily an extreme end of the third radiation conductor 5, besides, a position at which a part of the second radiation conductor 4 is to be connected with the outer conductor 82 in the coaxial line 8 is not necessarily fixed to an end of the second radiation conductor 4 dependent upon the number of radio waves to be emitted, its frequency band, and characteristics to be intended.

Furthermore, a position at which the inner conductor 81 in the coaxial line 8 is to be connected with a part of the third radiation conductor 5 may be a position in a part of a periphery where the third radiation conductor 5 has been branched from the first radiation conductor 3.

In the constitution of FIG. 25, the first radiation structure is composed of an electric current (J1) 13 and an electric current (J2) 131 as shown in FIG. 26, while the second radiation structure is essentially composed of an electric current (J3) 132 and the electric current (J2) 131.

According to the constitution as described above, the plate-like multiple antenna 102 by which radio waves in two frequency bands applied can be emitted is realized.

Example 4

Figure 27:
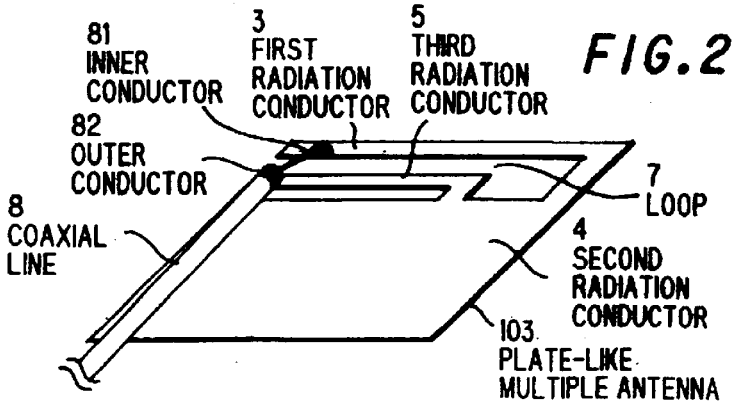
FIG. 27 is a perspective view showing a plate-like multiple antenna according to example 4 of the present invention.
Figure 28:
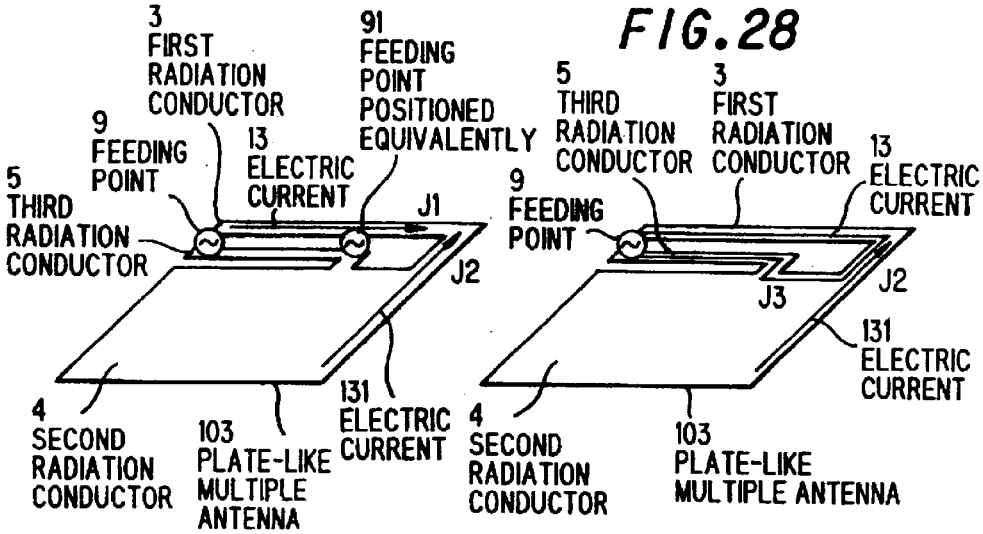
FIG. 28 is an electrical constitutional diagram showing a plate-like multiple antenna according to example 4 of the present invention.

A fourth example of the present invention is described by referring to FIGS. 27 and 28 wherein FIG. 27 shows a constitution of a plate-like multiple antenna 103 according to the present invention in the case where a third radiation conductor 5 is added to a part of a second radiation conductor 4, a part of a first radiation conductor 3 is connected with an inner conductor 81 of a coaxial line 8, and further, a part of the third radiation conductor 5 is connected with an outer conductor 82 of the coaxial line 8, whereby power supply is implemented.

It is to be understood that these connecting positions are determined with taking constitutions of the first radiation structure and the second radiation structure by which radio waves in a plurality of frequency bands applied can be emitted as well as impedance matching of an antenna into consideration.

More specifically, a position at which the inner conductor 81 in the coaxial line 8 is to be connected with a part of the first radiation conductor 3 is not necessarily an extreme end or a vicinity thereof, besides, a position at which a part of the third radiation conductor 5 is to be connected with the outer conductor 82 in the coaxial line 8 is not necessarily an extreme end of the third radiation conductor 5 dependent upon the number of radio waves to be emitted, its frequency band, and characteristics to be intended.

Furthermore, a position at which the outer conductor 82 in the coaxial line 8 is to be connected with a part of the third radiation conductor 5 may be a position in a part of a periphery where the third radiation conductor 5 has been branched from the second radiation conductor 4.

In the constitution of FIG. 27, the first radiation structure is composed of an electric current (J1) 13 and an electric current (J2) 131 as shown in FIG. 28, while the second radiation structure is essentially composed of an electric current (J3) 132 and the electric current (J2) 131.

According to the constitution as described above, the plate-like multiple antenna 103 by which radio waves in two frequency bands applied can be emitted is realized.

Example 5

Figure 29:
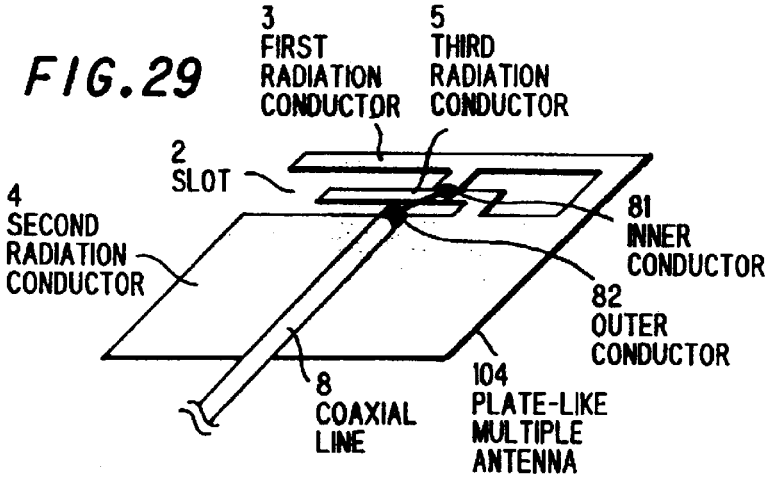
FIG. 29 is a perspective view showing a plate-like multiple antenna according to example 5 of the present invention.
Figure 30:
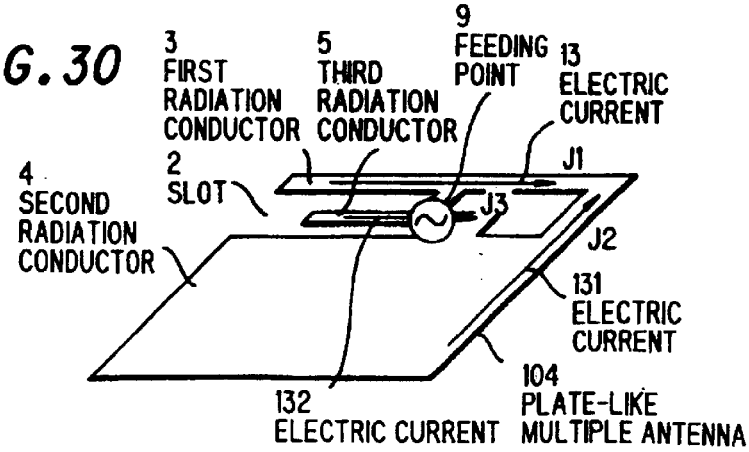
FIG. 30 is an electrical constitutional diagram showing a plate-like multiple antenna according to example 5 of the present invention.

A fifth example of the present invention is described in conjunction with FIGS. 29 and 30 wherein FIG. 29 shows a constitution of a plate-like multiple antenna 104 according to the present invention in the case where a third radiation conductor 5 is added to a part of a second radiation conductor 4, a part of the third radiation conductor 5 is connected with a part of a first radiation conductor 3 wherein a dimension of the third radiation conductor 5 constituting the second radiation structure is made to be about ¼ of a wavelength of radio wave, which can be emitted by the second radiation structure, a part of the third radiation conductor 5 is connected with an inner conductor 81 of a coaxial line 8, and further, a part of the second radiation conductor 4 is connected with an outer conductor 82 in the coaxial line 8, whereby power supply is implemented.

It is to be understood that these connecting positions are determined with taking constitutions of the first radiation structure and the second radiation structure by which radio waves in a plurality of frequency bands applied can be emitted as well as impedance matching of an antenna into consideration.

More specifically, a position at which the inner conductor 81 in the coaxial line 8 is to be connected with a part of the third radiation conductor 5 is not a periphery at which the third radiation conductor 5 is connected with the first radiation conductor 3, besides, a position at which a part of the second radiation conductor 4 is to be connected with the outer conductor 82 in the coaxial line 8 is not necessarily a position in the vicinity of the center of the second radiation conductor 4 dependent upon the number of radio waves to be emitted, its frequency band, and characteristics to be intended.

Furthermore, a position at which the inner conductor 81 in the coaxial line 8 is to be connected with a part of the third radiation conductor 5 may be a position in a part of a periphery where the third radiation conductor 5 has been branched from the first radiation conductor 3, a position at which the outer conductor 82 in the coaxial line 8 is to be connected with a part of the second radiation structure 4 may be a part of a periphery where the third radiation conductor 5 is to be connected with the second radiation conductor 4.

At a power feeding position of FIG. 29, the first radiation structure is composed of an electric current (J1) 13 and an electric current (J2) 131 as shown in FIG. 30, while the second radiation structure is essentially composed of an electric current (J3) 132 and the electric current (J2) 131.

According to the constitution as described above, the plate-like multiple antenna 104 by which radio waves in two frequency bands applied can be emitted is realized.

In the constitution of FIG. 29, when a gap as described in example 1 or 2 is considered in the first radiation structure and the second radiation structure, each directional pattern can be shifted in both the structures.

Example 6

Figure 31A:
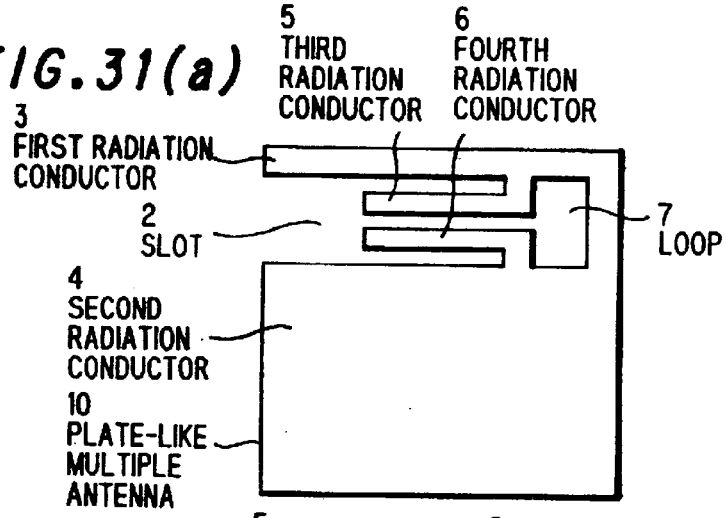
FIGS. 31(*a*), 31(*b*), and 31(*c*) are constitutional diagrams each showing a plate-like multiple antenna according to example 6 of the present invention.
Figure 31B:
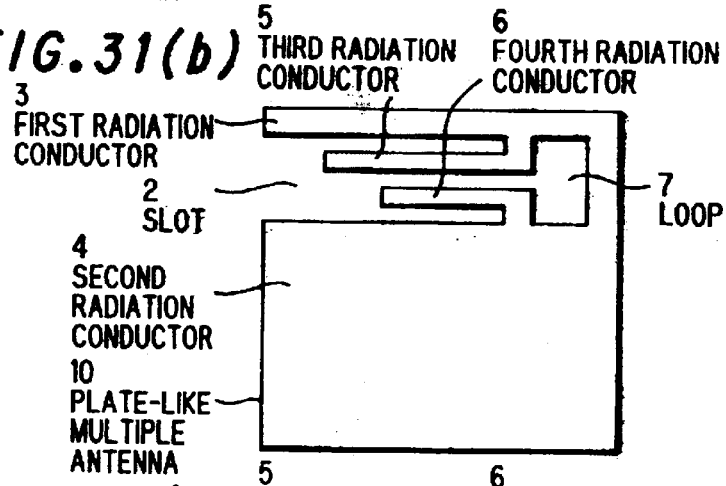
Figure 31C:
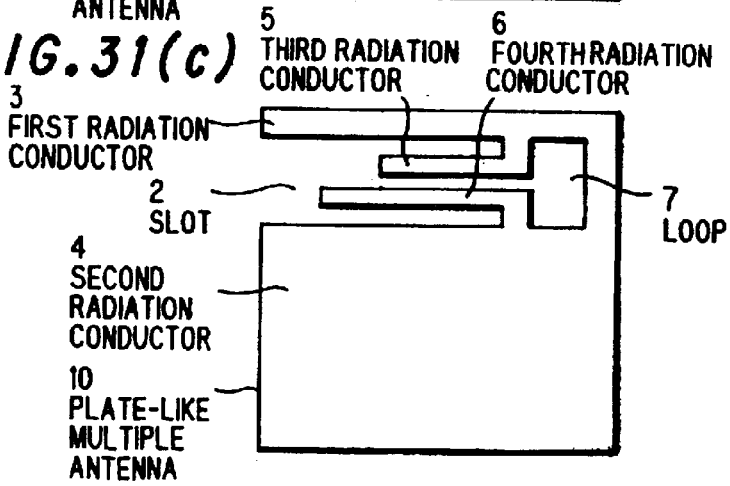
Figure 32:
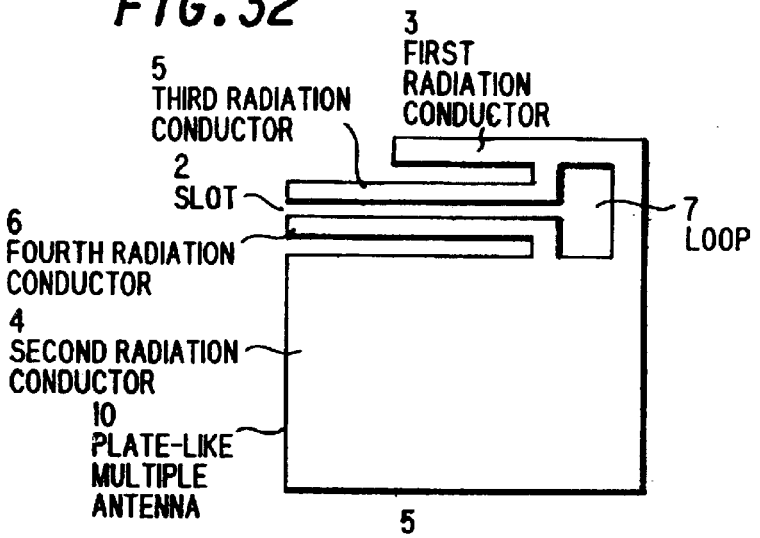
FIG. 32 is a constitutional diagrams showing the plate-like multiple antenna according to example 6 of the present invention.

A sixth example of the present invention is described by referring to FIGS. 31(*a*), 31(*b*), and 31(*c*) as well as FIG. 32 wherein each of FIGS. 31(*a*), 31(*b*), and 31(*c*) shows a plate-like multiple antenna 10 according to the present invention in which a third radiation conductor 5 and a fourth radiation conductor 6 are connected to a part of a first radiation conductor 3 and a part of a second radiation conductor 4, which define a slot 2. In these figures, FIG. 31(*a*) shows a constitution wherein a length of the third radiation conductor 5 is the same as that of the fourth radiation conductor 6, while each of FIGS. 31(*b*) and 31(*c*) shows a constitution wherein both the lengths differ from one another.

These constitutions are those corresponding to various power feeding structures in the case where a plate-like multiple antenna 10 of the present invention is used. Furthermore, they are also those, which are intentionally executed in the case where electrical interference and the like is considered in the event where on and after the third radiation conductors are added.

In these constitutions, a plate-like multiple antenna 10 by which radio waves in two frequency bands applied can be emitted is also realized as in the above-described examples.

FIG. 32 differs from FIGS. 31(*a*), 31(*b*), and 31(*c*), and it indicates a constitution wherein a first radiation conductor 3 is made to be shorter than the third radiation conductor 5 and the fourth radiation conductor 6.

The constitution of FIG. 32 has the same advantageous effects and the purposes as that of FIGS. 31(*a*), 31(*b*), and 31(*c*), and hence, a plate-like multiple antenna 10, which can correspond to two frequency bands of radio waves applied as in the above-described examples is realized.

The constitutions shown in FIGS. 31(*a*), 31(*b*), and 31(*c*) as well as FIG. 32 exhibit such a characteristic feature of a plate-like multiple antenna 10 according to the present invention that a combination of a length of the first radiation conductor 3 and that of on and after the third radiation conductor can be altered so as to obtain a predetermined excitation pattern and a predetermined directional pattern in respective frequencies applied.

Example 7

Figure 33A:
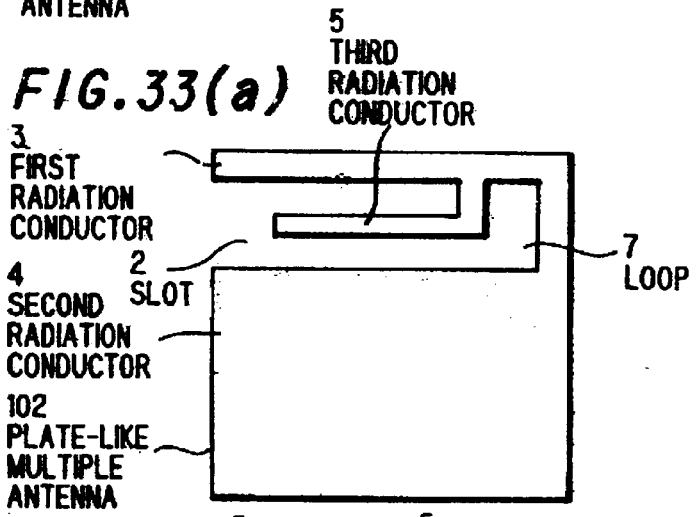
FIGS. 33(*a*), and 33(*b*) are constitutional diagrams each showing a plate-like multiple antenna according to example 7 of the present invention.
Figure 33B:
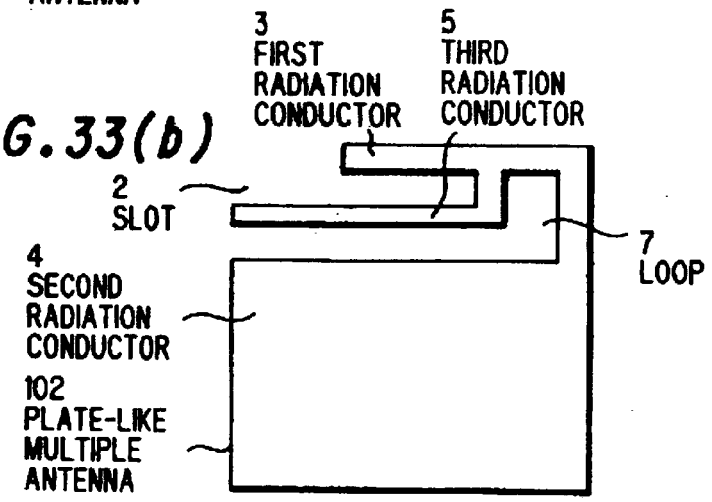

A seventh example of the present invention is described in conjunction with FIGS. 33(*a*) and 33(*b*). FIGS. 33(*a*) and 33(*b*) shows each of plate-like multiple antennas 102 in the case where a third radiation conductor 5 is added to a part of a first radiation conductor 3 wherein a length of the first radiation conductor 3 differs from that of the third radiation conductor 5.

These constitutions are those corresponding to various power feeding structures in the case where a plate-like multiple antenna 102 of the present invention is used. Furthermore, they are also those, which are intentionally executed in the case where electrical interference and the like is considered in the event where on and after the third radiation conductors are added.

In these constitutions, a plate-like multiple antenna 102 by which radio waves in two frequency bands applied can be emitted is also realized as in the above-described examples.

The constitutions shown in FIGS. 33(*a*), and 33(*b*) exhibit such a characteristic feature of a plate-like multiple antenna 102 according to the present invention that a combination of a length of the first radiation conductor 3 and that of the third radiation conductor 5 can be altered so as to obtain a predetermined excitation pattern and a predetermined directional pattern in respective frequencies applied.

Example 8

Figure 34A:
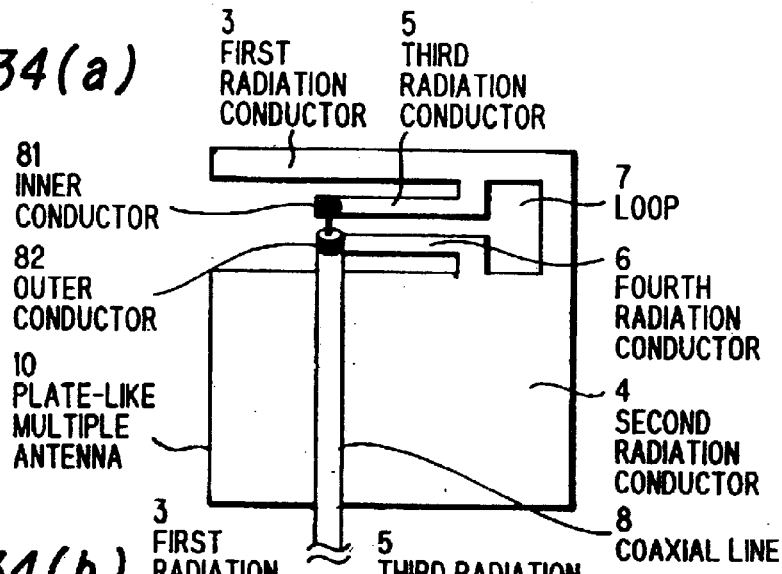
FIGS. 34(*a*), 34(*b*), and 34(*c*) are constitutional diagrams each showing a plate-like multiple antenna according to example 8 of the present invention.
Figure 34B:
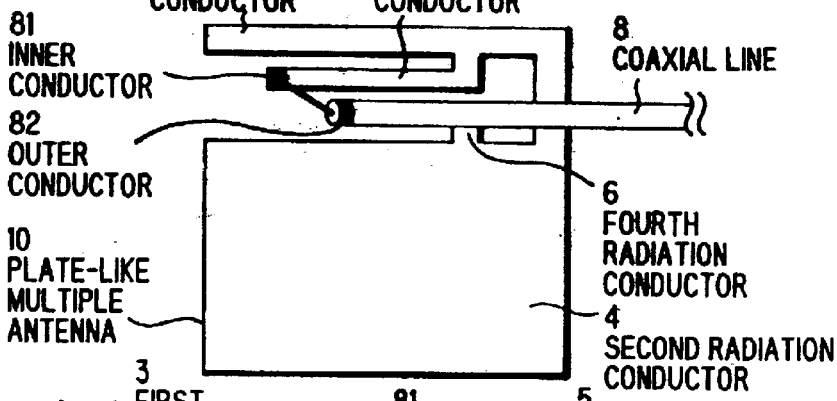
Figure 34C:
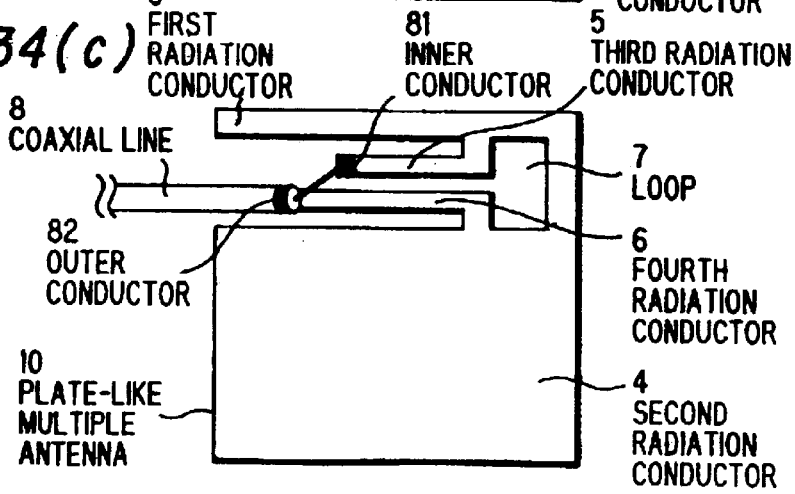
Figure 35A:
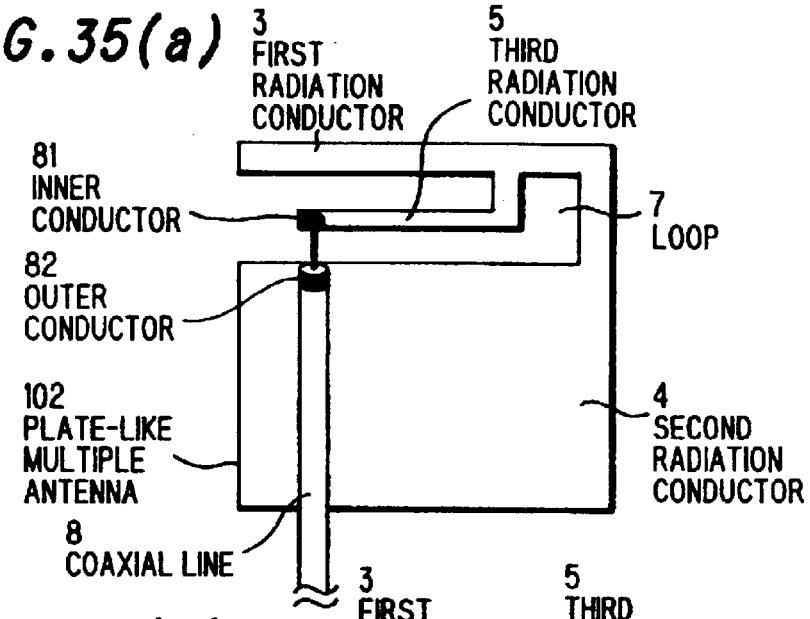
FIGS. 35(*a*), 35(*b*), and 35(*c*) are constitutional diagrams each showing the plate-like multiple antenna according to example 8 of the present invention.
Figure 35B:
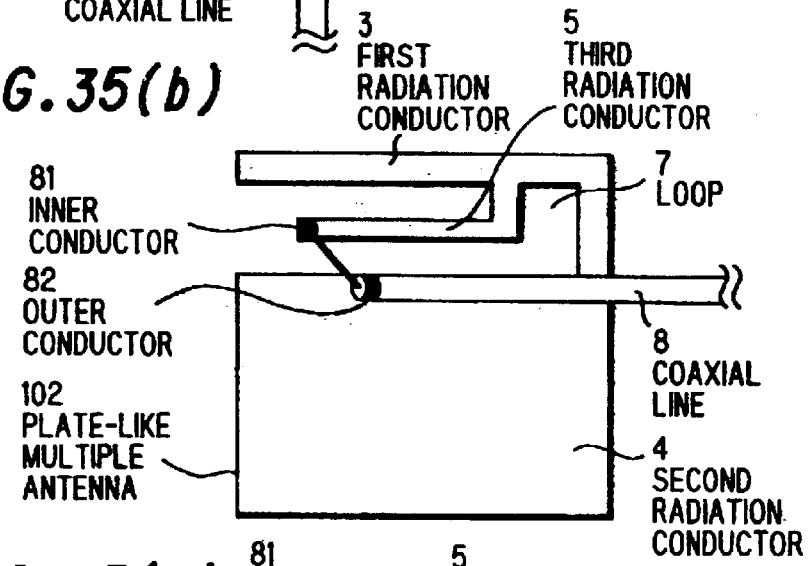
Figure 35C:
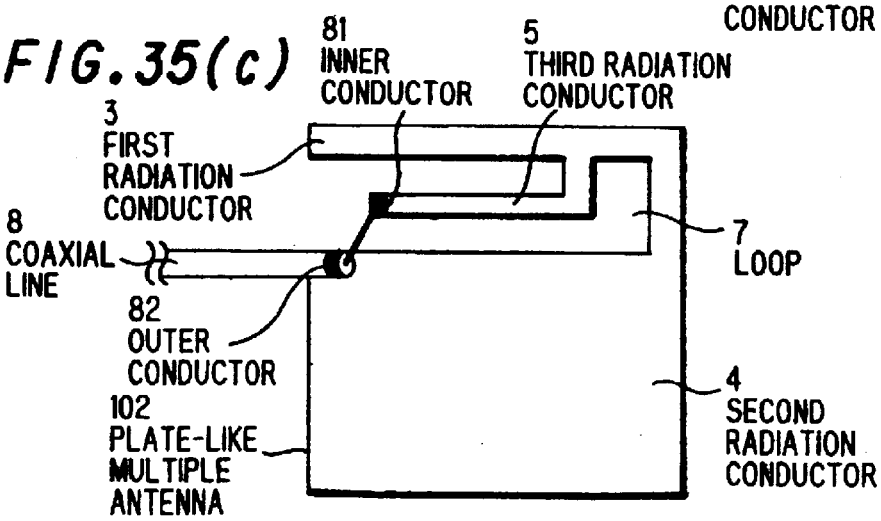

An eighth example of the present invention is described by referring to FIGS. 34(*a*), 34(*b*), and 34(*c*) as well as FIGS. 35(*a*), 35(*b*), and 35(*c*) wherein FIGS. 34(*a*), 34(*b*), and 34(*c*) show a variety of examples in the case where a coaxial line 8 is connected to the plate-like multiple antenna 10 of example 6 according to the present invention, while FIGS. 35(*a*), 35(*b*), and 35(*c*) show a variety of examples in the case where a coaxial line 8 is connected to the plate-like multiple antenna 102 of example 7 according to the present invention, respectively.

According to the plate-like multiple antennas 10 and 102 of the present invention, it is possible to expand a degree of freedom in a direction where the coaxial line 8 can be positioned without folding the coaxial line 8, so that the antennas can correspond flexibly to a direction of the coaxial line 8 to be positioned, respectively.

A constitution of power feeding structure in a plate-like multiple antenna according to the present invention can select not only execution of fusion splice for a coaxial line and the like by means of a conductive soldering material, but also use of a connector and the like for connection dependent upon intended purposes.

Example 9

Figure 36:
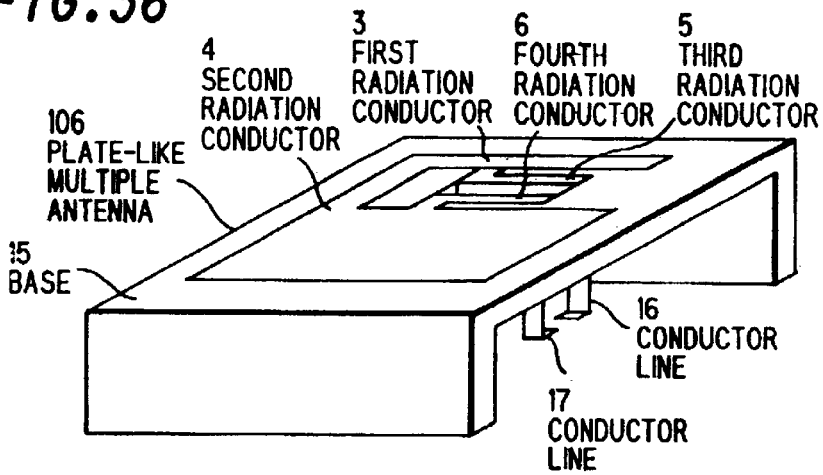
FIG. 36 is a constitutional diagrams showing the plate-like multiple antenna according to example 9 of the present invention.

A ninth example of the present invention will be described by referring to FIG. 36 showing a plate-like multiple antenna 106 according to the present invention wherein a power feeding structure of the plate-like multiple antenna 10 according to the present invention described in example 6 is modified, and it is constituted on a three-dimensional base 15 having a flat top.

The plate-like multiple antenna 106 may be fabricated by such a processing manner that a plating material or the like is applied to the base 15.

The base 15 has such a structure that a part sandwiched by a third radiation conductor 5 and a fourth radiation conductor 6 is made to be vacant, and a conductor line 16 is extended downwards from the third radiation conductor 5 at a position where impedance matching is considered, while a conductor line 17 is extended downwards from the fourth radiation conductor 6 at a position where impedance matching is considered, whereby power can be supplied under the base.

This structure is the one by which a plate-like multiple antenna of the present invention can be housed in a cellular phone, or it can be fixed to a certain place.

The base 15 is made of an insulating material, and in this respect, it is preferred that a material (dielectric constant) should be selected on the basis of a request for downsizing the plate-like multiple antenna 106.

On one hand, it may be arranged in such that a wiring pattern (not shown) formed on a circuit board is used for a power feeding line to the plate-like multiple antenna 106, and the base 15 is installed on the circuit board thereby to connect the wiring pattern with the above-described conductor lines 16 and 17, respectively.

In this case, it is to be understood that each sectional area and each length of the guide lines 16 and 17 have been set in such that they are not connected with an external ground in high-frequency manner.

Example 10

Figure 37A:
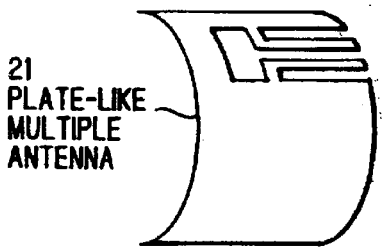
FIGS. 37(*a*), and 37(*b*) are constitutional diagrams each showing a plate-like multiple antenna according to example 10 of the present invention.
Figure 37B:
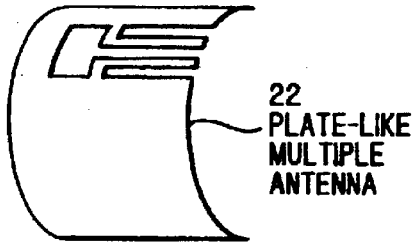

A tenth example of the present invention is described in conjunction to FIGS. 37(*a*) and 37(*b*) wherein FIG. 37(*a*) shows a plate-like multiple antenna 21 a contour of which has been dimensionally modified dependent upon a configuration or a situation in a position where the antenna is to be installed, while FIG. 37(*b*) shows a plate-like multiple antenna 22 a contour of which has been dimensionally modified dependent upon a configuration or a situation in a position where the antenna is to be installed.

Each of a first radiation conductor 3, a second radiation conductor 4, a third radiation conductor 5, and a fourth radiation conductor 6, which define either of slots in the plate-like multiple antennas 21 and 22, has been worked, so that the whole surface of a conductor plate has been curved.

Example 11

Figure 38A:
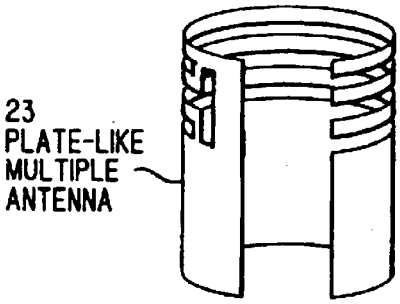
FIGS. 38(*a*), and 38(*b*) are constitutional diagrams each showing a plate-like multiple antenna according to example 11 of the present invention.
Figure 38B:
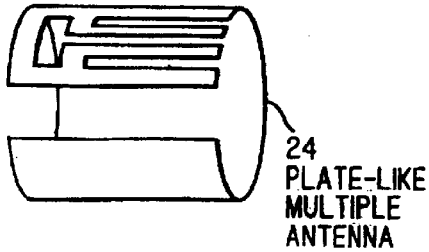

An eleventh example of the present invention is described by referring to FIGS. 38(*a*) and 38(*b*) wherein FIG. 38(*a*) shows a plate-like multiple antenna 23 a contour of which has been dimensionally modified dependent upon a configuration or a situation in a position where the antenna is to be installed, while FIG. 38(*b*) shows a plate-like multiple antenna 24 a contour of which has been dimensionally modified dependent upon a configuration or a situation in a position where the antenna is to be installed.

Each of a first radiation conductor 3, a second radiation conductor 4, a third radiation conductor 5, and a fourth radiation conductor 6, which define either of slots in the plate-like multiple antennas 23 and 24, has been worked, so that the whole surface of a conductor plate has been formed cylindrically.

The plate-like multiple antenna 23 shown in FIG. 38(*a*) is the one, which is fabricated by bending the same in a length direction of the first radiation conductor 3 (i.e., a width direction of the second radiation conductor 4), while the plate-like multiple antenna 24 shown in FIG. 38(*b*) is the one, which is fabricated by bending the same in a length direction of the conductor plate.

Example 12

Figure 39A:
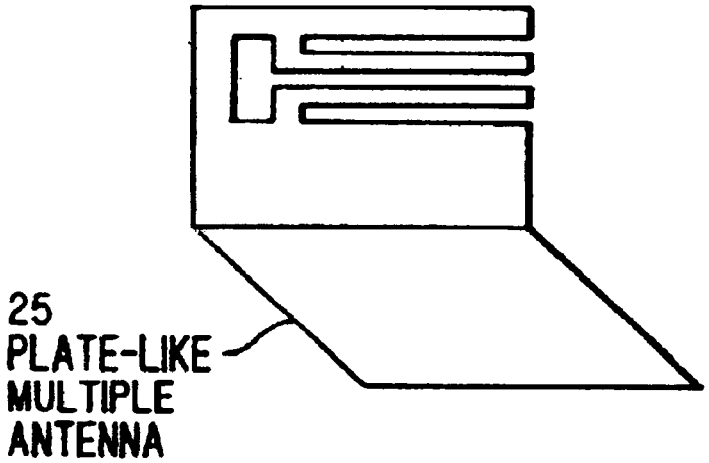
FIGS. 39(*a*), and 39(*b*) are constitutional diagrams each showing a plate-like multiple antenna according to example 12 of the present invention.
Figure 39B:
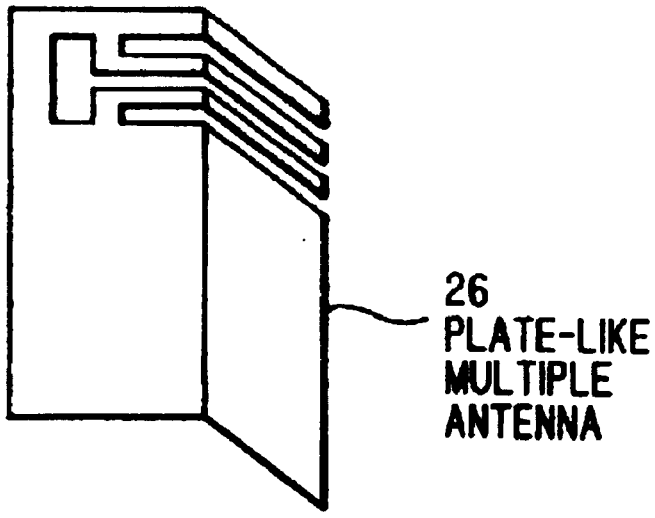
Figure 40A:
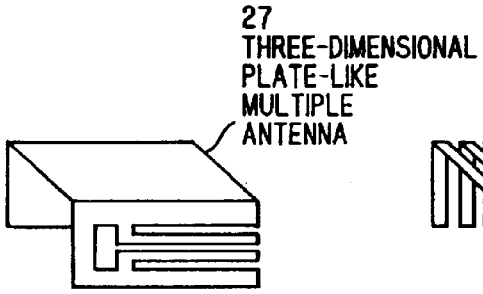
FIGS. 40(*a*), 40(*b*), 40(*c*), 40(*d*), 40(*e*), and 40(*f*) are constitutional diagrams each showing a plate-like multiple antenna according to example 13 of the present invention.
Figure 40B:
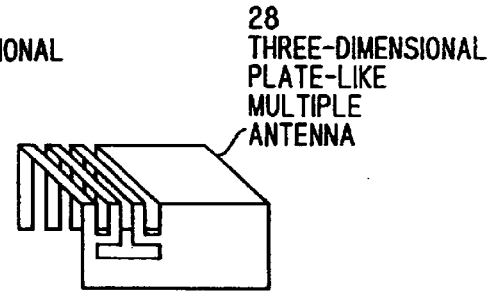
Figure 40C:
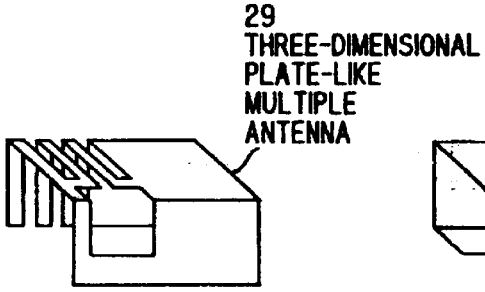
Figure 40D:
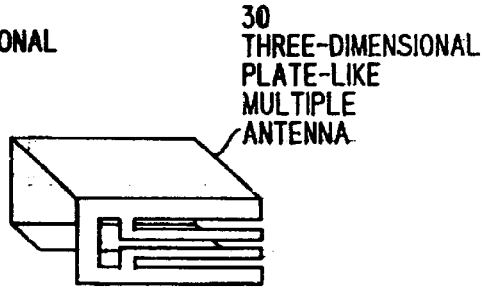
Figure 40E:
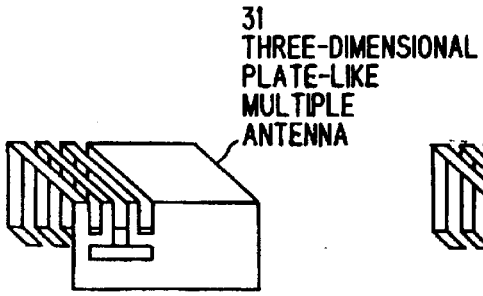
Figure 40F:
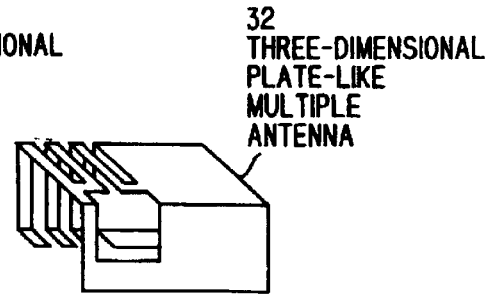

A twelfth example of the present invention is described by referring to FIGS. 39(*a*) and 39(*b*) wherein FIG. 39(*a*) shows a plate-like multiple antenna 25 a contour of which has been dimensionally modified dependent upon a configuration or a situation in a position where the antenna is to be installed, while FIG. 39(*b*) shows a plate-like multiple antenna 26 a contour of which has been dimensionally modified dependent upon a configuration or a situation in a position where the antenna is to be installed.

The plate-like multiple antenna 25 shown in FIG. 39(*a*) is the one, which is fabricated by folding the same so as to provide one crease in a width direction of the second radiation conductor 4, while the plate-like multiple antenna 26 shown in FIG. 39(*b*) is the one, which is fabricated by folding the same so as to provide one crease in a length direction of the conductor plate as a result of folding the first radiation conductor 3, the second radiation conductor 4, the third radiation conductor 5, and the fourth radiation conductor 6 at one site of them, respectively.

Example 13

A thirteenth example of the present invention will be described by referring to FIGS. 40(*a*), 40(*b*), 40(*c*), 40(*d*), 40(*e*), and 40(*f*) wherein FIG. 40(*a*) shows a plate-like multiple antenna 27 a contour of which has been dimensionally modified dependent upon a configuration or a situation in a position where the antenna is to be installed, FIG. 40(*b*) shows a plate-like multiple antenna 28 a contour of which has been dimensionally modified dependent upon a configuration or a situation in a position where the antenna is to be installed, FIG. 40(*c*) shows a plate-like multiple antenna 29 a contour of which has been dimensionally modified dependent upon a configuration or a situation in a position where the antenna is to be installed, FIG. 40(*d*) shows a plate-like multiple antenna 30 a contour of which has been dimensionally modified dependent upon a configuration or a situation in a position where the antenna is to be installed, FIG. 40(*e*) shows a plate-like multiple antenna 31 a contour of which has been dimensionally modified dependent upon a configuration or a situation in a position where the antenna is to be installed, and FIG. 40(*f*) shows a plate-like multiple antenna 32 a contour of which has been dimensionally modified dependent upon a configuration or a situation in a position where the antenna is to be installed.

The plate-like multiple antenna 27 shown in FIG. 40(*a*) is the one, which is fabricated by folding the same so as to provide two creases in a width direction of a second radiation conductor 4.

The plate-like multiple antenna 28 shown in FIG. 40(*b*) is the one, which is fabricated by folding the same so as to provide two creases in a length direction of the conductor plate as a result of folding a first radiation conductor 3, the second radiation conductor 4, a third radiation conductor 5, and a fourth radiation conductor 6 defining slots, respectively, at two sites of them, respectively.

The plate-like multiple antenna 29 shown in FIG. 40(*c*) is the one, which is fabricated by folding the same so as to provide two creases in a length direction of the conductor plate by means of replacing an additional section of the third radiation conductor 5 from the first radiation conductor 3 by an additional section of the fourth radiation conductor 6 from the second radiation conductor 4 in the constitution of FIG. 40(*b*) to fold the first radiation conductor 3 and the second radiation conductor 4 defining a slot, respectively, at two sites of them, and folding the third radiation conductor 5 and the fourth radiation conductor 6 at one site of them, respectively.

The plate-like multiple antenna 30 shown in FIG. 40(*d*) is the one, which is fabricated by folding the same so as to provide three creases in a width direction of a second radiation conductor 4.

The plate-like multiple antenna 31 shown in FIG. 40(*e*) is the one, which is fabricated by folding the same so as to provide three creases in a length direction of the conductor plate as a result of folding a first radiation conductor 3, the second radiation conductor 4, a third radiation conductor 5, and a fourth radiation conductor 6, which define slots, at three sites of them, respectively.

The plate-like multiple antenna 32 shown in FIG. 40(*e*) is the one, which is fabricated by folding the same so as to provide three creases in a length direction of the conductor plate by means of replacing an additional section of the third radiation conductor 5 from the first radiation conductor 3 by an additional section of the fourth radiation conductor 6 from the second radiation conductor 4 in the constitution of FIG. 40(*e*) to fold the first radiation conductor 3 and the second radiation conductor 4 defining a slot, respectively, at three sites of them, and folding the third radiation conductor 5 and the fourth radiation conductor 6 at two sites of them, respectively.

Example 14

A fourteenth example of the present invention will be described by referring to FIGS. 41(*a*), 41(*b*), and 41(*c*) wherein FIG. 41(*a*) shows a disc-shaped plate-like multiple antenna 33 a contour of which has been defined into a disc dependent upon a configuration or a situation in a position where the antenna is to be installed, FIG. 41(*b*) shows a disc-shaped plate-like multiple antenna 34 a contour of which has been defined into a disc dependent upon a configuration or a situation in a position where the antenna is to be installed, and FIG. 41(*c*) shows a disc-shaped plate-like multiple antenna 35 a contour of which has been defined into a disc dependent upon a configuration or a situation in a position where the antenna is to be installed.

Figure 41A:
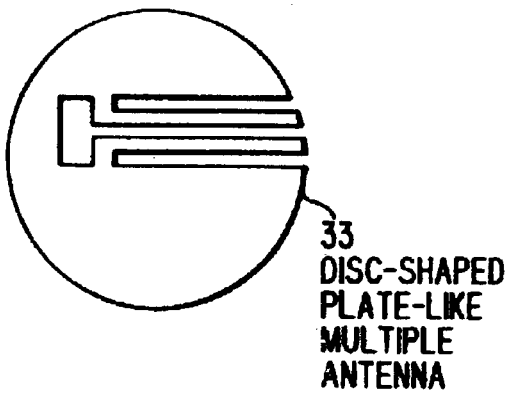
FIGS. 41(*a*), 41(*b*), and 41(*c*) are constitutional diagrams each showing a plate-like multiple antenna according to example 14 of the present invention.
Figure 41B:
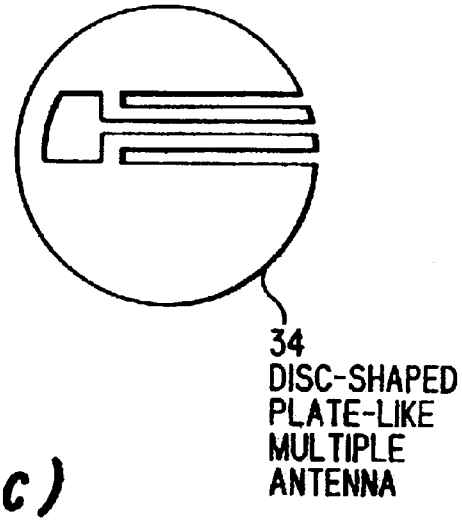
Figure 41C:
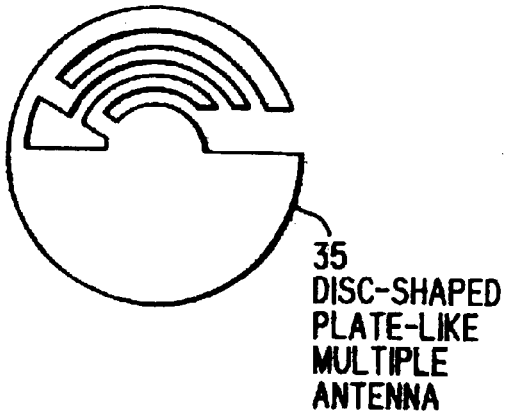

In the plate-like multiple antennas 33 and 34 shown in FIGS. 41(*a*) and 41(*b*), each slot 2 of them is defined linearly, while a slot 2 in the plate-like multiple antenna 35 shown in FIG. 41(*c*) is defined in a substantially semicircular profile.

Example 15

A fifteenth example of the present invention will be described in conjunction with FIGS. 42(*a*), 42(*b*), and 42(*c*) wherein FIG. 42 (*a*) shows a curved plate-like multiple antenna 36 a contour of which has been curved dependent upon a configuration or a situation in a position where the antenna is to be installed, FIG. 42(*b*) shows a curved plate-like multiple antenna 37 a contour of which has been curved dependent upon a configuration or a situation in a position where the antenna is to be installed, and FIG. 42(*c*) shows a curved plate-like multiple antenna 38 a contour of which has been curved dependent upon a configuration or a situation in a position where the antenna is to be installed.

Figure 42A:
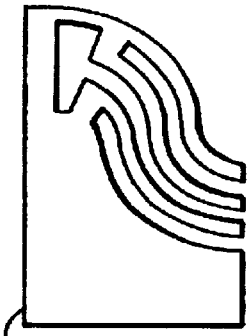
FIGS. 42(*a*), 42(*b*), and 42(*c*) are constitutional diagrams each showing a plate-like multiple antenna according to example 15 of the present invention.
Figure 42B:
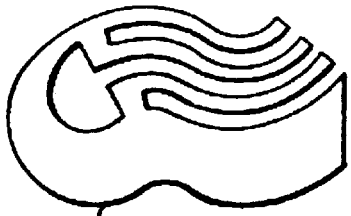
Figure 42C:
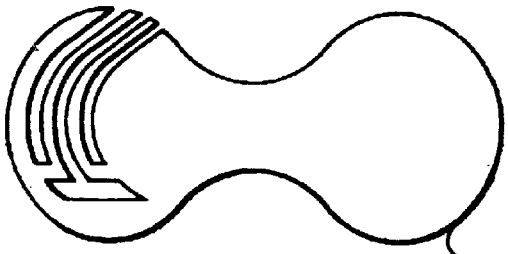

The plate-like multiple antenna 36 shown in FIG. 42(*a*) has been formed in such that a first radiation conductor 3 defining a slot is configured so as to draw an S-shaped curve, and further, a side of a second radiation conductor 4 defining a slot and opposite to the first radiation conductor 3 as well as a third radiation conductor 5 and a fourth radiation conductor 6 are also curved so as to respond to the S-shaped curve.

The plate-like multiple antenna 37 shown in FIG. 42(*b*) has been formed in such that both of the first radiation conductor 3 and the second radiation conductor 4 defining slots, besides, the third radiation conductor 5 and the fourth radiation conductor 6 are also configured so as to draw an S-shaped curve along a length direction of the first radiation conductor 3 (i.e., a width direction of the second radiation conductor 4) defining the slots.

The plate-like multiple antenna 38 shown in FIG. 42(*c*) has been formed in such that a contour of the conductor plate is configured in substantially eye-glass shape wherein slots 2 are curved.

A contour of a plate-like multiple antenna is not limited to those mentioned in the above respective examples, antennas having a variety of contours dependent upon a configuration or a situation in a position where an antenna is to be installed may be employed.

When a profile and its position of a slot as well as each contour and constitution of on and after third radiation conductors are determined, a configuration of a conductor plate may be variously modified.

In a first radiation structure, a length of a first radiation conductor 3 may be set to be odd-number times larger than about ¼ of a wavelength of radio wave in one frequency band among a plurality of frequency bands applied, and the resulting length is not required to be the same as a width of a second radiation conductor 4.

Furthermore, a length of profile and a structure may be set to be about 1/1, ½, ¼, ⅛ or their multiple numbers of a wavelength of radio wave in other frequencies in a second radiation structure with respect to on and after third radiation conductors.

Thus, a plate-like multiple antenna according to the present invention can be flexibly adapted to a space or a structure into which the plate-like multiple antenna is to be housed thereby to attain downsizing of a product.

Moreover, since a structure of a plate-like multiple antenna can be freely selected, the antenna can be flexibly adapted to a required directional pattern.

It is to be understood that sizes of respective parts in a plate-like multiple antenna are decided in such that dielectric constants in a variety of materials used in a cabinet or the like into which the plate-like multiple antenna is to be installed or influences of conductor parts are considered, these sizes are matched with wavelengths of radio waves in respective frequency bands applied in case of actual built-in antenna is to be accommodated, and a good excitation pattern is obtained irrespective of existence of modification in the antenna.

Besides, when a plate-like multiple antenna is installed to a cabinet of equipment, the whole thereof is covered with an insulating film such as a laminate material, or conductors positioned in peripheries of the plate-like multiple antenna are removed, whereby connection of the antenna with conductor parts in equipment or an earthing section (ground) in high-frequency manner is insulated. As a result, the antenna can maintain its original characteristics, and achieve excellent antenna characteristic property.

In addition, according to a plate-like multiple antenna of the present invention, a directional pattern can be shifted in a first radiation structure as described in examples 1 and 2, and it is possible to suppress a directional pattern in a certain direction. With respect to a second radiation structure, it is also possible to suppress a directional pattern.

For this reason, when a plurality of plate-like multiple antennas of the present invention are disposed adjacent to each other, electromagnetic interference appearing between adjacent antennas can be suppressed, so that a distance defined between adjacent antennas to be disposed can be reduced.

In accordance with a plate-like multiple antenna according to examples 1 through 15 of the present invention, it becomes possible to provide a useful antenna having the following advantages in place of a conventional external antenna, which is used in personal digital assistance or equipment (electric appliance) for wireless network in home in such a manner that a separate cabinet is used outside a main body cabinet, and such antenna is attached the separate cabinet by the use of a separate cable.

On the other hand, the plate-like multiple antenna according to the present invention has such advantages that troubles of detachment, reinstallation, readjustment and the like of an antenna as well as damage of the antenna itself arising in case of transfer can be saved, that a degree of freedom in a position at which personal digital assistance or electric appliance to be installed, that it is not required to alter remarkably a specification for a position of a cabinet or a variety of parts to be installed due to which causes for in creasing manufactures' costs of products, prolongation of a term for development and the like arise, that the antenna can be housed in a space such as a small clearance in a cabinet, that the antenna can be produced with an inexpensive cost, besides its performance is assured, and that it is possible to apply a single antenna for a plurality of communication systems in different frequency bands applied.

In brief, according to the present invention, a plate-like multiple antenna and electrical equipment provided therewith wherein the antenna can be housed in digital personal assistance, electric appliances, walls or the like with a small space, and further the resulting antenna is inexpensive and assures its performance can be provided.

The presently disclosed embodiment is therefore considered in all respects to be illustrative and not restrictive. The scope of the invention is indicated by the appended claims rather than the foregoing description, and all changes that come within the meaning and range of equivalents thereof are intended to be embraced therein.

What is claimed is:

1. A plate-like multiple antenna, for transmitting and receiving one radio wave and another radio wave each having different wavelengths, comprising:

a conductor plate;

a slot formed by notching said conductor plate;

a first radiation conductor formed of said conductor plate at one side of said slot;

a second radiation conductor formed of said conductor plate at another side of said slot;

a loop antenna constituted by a third and a fourth radiation conductors respectively connected with said first and second radiation conductors in said slot; and a power source for feeding power to said third and fourth radiation conductors.

2. A plate-like multiple antenna as claimed in claim 1, wherein:

said conductor plate is separately provided from a ground section of a high-frequency circuitry in equipment on which said antenna is to be loaded.

3. A plate-like multiple antenna as claimed in claim 1, wherein:

said slot is defined at a position where it deviates from the center of said conductor plate, and said first radiation conductor formed at one side of said slot has a surface larger than that of said second radiation conductor.

4. A plate-like multiple antenna as claimed in claim 3, wherein:

a dimension of said first radiation conductor corresponding to a longitudinal direction of said slot is set to be an odd number times larger than an about ¼ of a wavelength in one radio wave among a plurality of radio waves applied.

5. A plate-like multiple antenna as claimed in claim 4 wherein:

a width of said slot is set to be ⅛ or less than that of a wavelength of one radio wave among a plurality of radio waves applied.

6. A plate-like multiple antenna as claimed in claim 4, wherein: a longitudinal dimension of a routing line of electric current distribution of said loop antenna constituted by said third and fourth radiation conductors in said slot is set to be an integer number times larger than about ⅛ of a wavelength of said another radio wave.

7. A plate-like multiple antenna as claimed in claim 1, wherein: said conductor plate is formed on an insulative base, a part of conductor edges of said third and fourth radiation conductors in said slot is extended to downwards of said base, said extended part of said third and fourth radiation conductors is electrically connected with a wiring pattern formed on a substrate of a high-frequency circuit and in said slot, and said power is fed to said third and fourth radiation conductors through said wiring pattern.

8. A plate-like multiple antenna as claimed in claim 7, wherein:

said conductor plate is covered with an insulating material.

9. A plate-like multiple antenna as claimed in claim 1, wherein:

said power source comprises a coaxial line composed of an inner conductor and an outer conductor positioned on an outer periphery of said inner conductor, said inner conductor is formed of a single wire or a strand of plurality of wires, said inner and outer conductors are connected to said third and fourth radiation conductors respectively at one end of said coaxial line to constitute a power feeding line for said loop antenna and a monopole antenna constituted by said first and second radiation conductors.

10. Electrical equipment, comprising:

a plate-like multiple antenna as claimed in claim 9 disposed inside the equipment.

11. Electrical equipment, comprising:

two plate-like multiple antennas as claimed in claim 10 being installed in such a manner that conductor edges, which have been notched to define slots, respectively, are not opposed to each other.

12. A plate-like multiple antenna for transmitting and receiving one radio wave and another radio wave each having different wavelengths, comprising:

a conductor plate;

a slot formed by notching said conductor plate;

a first radiation conductor formed of said conductor plate at one side of said slot; a second radiation conductor formed of said conductor plate at another side of said slot;

a loop antenna constituted by a third radiation conductor connected with one of said first and second radiation conductors in said slot; and a power source for feeding power to said third radiation conductor and one of said first and second radiation conductors.

* * * * *